US006669236B1

(12) United States Patent
Höllwarth-Oberholz

(10) Patent No.: US 6,669,236 B1
(45) Date of Patent: Dec. 30, 2003

(54) MULTIPART LABEL FOR BLISTER PACKS, AND THE PRODUCTION AND USE THEREOF

(75) Inventor: Marc-Oliver Höllwarth-Oberholz, Waldsee (DE)

(73) Assignee: Abbott & GmbH & Co. KG, Ludwigshafen (DE)

( * ) Notice: Subject to any disclaimer, the term of this patent is extended or adjusted under 35 U.S.C. 154(b) by 99 days.

(21) Appl. No.: 09/688,830

(22) Filed: Oct. 17, 2000

(30) Foreign Application Priority Data

Oct. 21, 1999 (DE) ..... 199 50 781

(51) Int. Cl.[7] ..... B42D 15/00

(52) U.S. Cl. ..... 283/81; 206/534; 206/538; 283/101

(58) Field of Search ..... 283/81, 94, 98, 283/101, 105; 206/534, 538, 539

(56) References Cited

U.S. PATENT DOCUMENTS

| | | | | | |
|---|---|---|---|---|---|
| 2,790,587 | A | * | 4/1957 | Contant | 206/232 |
| 3,207,301 | A | | 9/1965 | Sparks | 206/47 |
| 4,717,176 | A | * | 1/1988 | Matthews | 229/68.1 |
| 4,817,310 | A | | 4/1989 | Breen et al. | 40/299 |
| 4,955,481 | A | | 9/1990 | Novinski et al. | 206/534 |
| 5,014,851 | A | * | 5/1991 | Wick | 206/461 |
| 5,613,349 | A | * | 3/1997 | Brown | 53/411 |
| 5,878,887 | A | * | 3/1999 | Parker et al. | 206/468 |
| 6,023,916 | A | * | 2/2000 | Bouthiette | 206/534 |
| 6,082,544 | A | * | 7/2000 | Romick | 206/531 |
| 6,273,260 | B1 | * | 8/2001 | ColDepietro et al. | 206/459.5 |
| 6,338,408 | B1 | * | 1/2002 | Anderson | 206/1.5 |
| 6,375,225 | B1 | * | 4/2002 | Lapsker | 206/528 |

FOREIGN PATENT DOCUMENTS

| | | |
|---|---|---|
| CA | 2216094 | 3/1998 |
| EP | 463 193 | 6/1990 |
| EP | 833 295 | 4/1998 |
| GB | 1 301 501 | 12/1972 |
| WO | WO 00/32412 | 6/2000 |

* cited by examiner

*Primary Examiner*—Monica Carter
(74) *Attorney, Agent, or Firm*—Keil & Weinkauf

(57) ABSTRACT

A multipart label for providing information on blister packs, having a text-carrying surface which is larger than the pack surfaces, comprises a sheet-like base element which, without obstructing the removal of the packed objects to any significant extent, is suitable for fixing the label on the pack which is to be labeled, or which is itself part of the pack, and also comprises one or more sheet-like information carriers which are fastened with swing action on the base element.

16 Claims, 10 Drawing Sheets

MULTIPART LABEL FOR BLISTER PACKS, AND THE PRODUCTION AND USE THEREOF

BACKGROUND OF THE INVENTION

The present invention relates to a multipart label for providing information on blister packs, having a text-carrying surface which is larger than the pack surfaces, comprising a sheet-like base element which, without obstructing the removal of the packed objects to any significant extent, is suitable for fixing the label on the pack which is to be labeled, or which is itself part of the pack, and also comprising one or more sheet-like information carriers which are fastened with swing action on the base element.

DESCRIPTION OF RELATED ART

For distributing relatively small quantities of small parts, it has been practice for some time now, and to a further-increasing extent, to package these in small packs. The advantage of this measure resides in making it possible for the consumer to be provided with a clearly visible supply of the material and, at the same time, in facilitating the sales procedure itself, for example by way of a self-service option. Thus, for example, screws or nails are retailed in small packs in a form in which they are sorted by size and design. Small technical subassemblies, e.g. miniature transformers, operational amplifiers, printer cartridges or miniature engines for model aircraft, are likewise retailed in a form in which they are packaged in small packs for reliable transportation and sales. In general terms, it can be said that all articles and materials which are to reach a user or consumer in a reliably protected form in relatively small quantities are expediently packaged in small containers. This applies particularly to materials which are provided for the medical treatment of humans and animals or which are to be used for scientific purposes and/or have to be handled with particular care. It is therefore absolutely essential for medicaments and, for example, clinical test drugs to reach the user or consumer in a secure pack which is adapted to the nature of the packed goods.

A problem arises when the consumer or user should, or has to, be given information on the pack contents. In particular in the case of medicaments and test drugs, it is necessary to pass on to the user or consumer extensive, detailed information on properties, handling and precautionary measures which should possibly be taken during use of the pack contents. It is frequently the case, in particular with drugs and test preparations, that there are legal regulations concerning the amount of information which is to be conveyed, which sometimes differs from country to country, with the result that, for global commerce, it is necessary to pass on to consumers and users country-specific information in the relevant languages.

Thus, for example, on account of EC GMP recommendations and directives as to well as national requirements, the labeling of clinical test samples with study-related data is becoming increasingly diverse and, nevertheless, is intended to have maximum flexibility in terms of use of the medication in as many countries as possible.

Up until now, it was possible, in particular, for small primary and secondary packs to be labeled merely on the actual pack surface/surfaces, which were obviously limited by the size of the pack. The provision of information, in particular of the various legally binding details and safety and handling information, by labeling, printing, stamping, punching, burning in or other processes was therefore very restricted or was not possible to the required extent. Although reducing the size of the text makes it possible to increase the quantity of information provided to a certain extent, the legibility and clarity are impaired.

Approaches to configure packs such that they can bear more content-related information than can be accommodated on the surface of said packs are already known. EP-A-833295 discloses a label for containers in which a plurality of folded information sheets are enclosed between a bottom sheet, which is adhesively bonded to the container, and a cover sheet provided above the bottom sheet. The cover sheet is fastened at its two ends on the container by adhesive-bonding surfaces such that one of the adhesive-bonding surfaces is a pressure-sensitive-adhesive surface which can be opened and closed again. Once the pressure-sensitive-adhesive surface has been opened, the information sheets can be removed. Once the information has been inspected, the information sheets can be positioned between the bottom sheet and cover sheet again and the cover sheet can be closed at the pressure-sensitive-adhesive surface. A significant disadvantage of this label is that it is possible for the information sheets to be separated from the container, lost and mixed up.

CA-A-2,216,094 discloses an arrangement which makes it possible to give out information on medicaments to certain individuals and for certain purposes. The arrangement, which may be fastened on the medicament pack, comprises a plurality of information sheets which are connected to one another in a severable manner at their edges via pressure-sensitive-adhesive surfaces to give a strip and are then folded together in zigzag form to give a stack. Individual information sheets are severed from the stack and distributed as intended. This arrangement thus does not constitute a label for reliable, permanent labeling of the pack contents.

The problems are increased further to a considerable extent if it is necessary to provide information on blister packs. As is known, these packs usually comprise a regular arrangement of a multiplicity of blister-like depressions which have been produced in an otherwise planar plastic sheet material—usually by thermoforming—and also comprise a cover fixed on the remaining planar surface area of the sheet material. The blister-like depressions serve for accommodating the packed objects, e.g. tablets or capsules, and the cover protects the objects against dropping out and against harmful environmental influences.

For removing the objects, the blister bases are pressed in the direction of the cover, as a result of which the packed objects are pressed onto the covering. The covering tears locally under the pressure of the packed object, i.e. over the opening of the blister which is to be emptied, and exposes the object.

On account of the unevennesses of the blister side of such a pack, relatively comprehensive content-related information can only be provided on the covering side, i.e. on the cover itself. Here, however, there is not just the disadvantage of the very restricted amount of space available; added to this is the fact that the information-carrying cover sheet material is destroyed when the goods are removed, with the result that it is very difficult, or totally impossible, to decipher the information printed thereon.

Of course, the necessary information could be conveyed to the user or consumer by pack inserts, but this method of passing on information does not satisfy the requirements of the AMG [Arzneimittelgesetz=Drugs Act], which prescribes, in particular for clinical test preparations, that the information and labeling be provided permanently on the pack itself. This is because, with loose pack inserts, there is always the risk of the latter being lost.

For some time now, there has thus been an urgent need if possible to provide packs with an information surface which is considerably larger than the pack surface as a whole.

Furthermore, in particular in the medical sector, there is a need for information on the contents or the coding of the contents of containers to be transferred to other articles, for it to be possible for said information to be conveyed to certain groups of individuals or for said information to be available for documentation purposes. The intention here is for sources of error to be eliminated if possible.

In order to solve this problem EP-B-0 463 193 proposes the use, for labeling a pack, for example a cylindrical bottle, of a strip-like self-adhesive label which is coated with coupling agent on the rear and which is longer than the circumference of the bottle, the overlapping part of the strip being formed as a severable section. On the front side, the label strip is provided, in the overlapping region, with an adhesive-repellant smooth layer. If the label is adhesively bonded around the bottle, then the severable section comes to rest on the smooth layer. Said section may thus be peeled off from the bottle together with its rear-side pressure-sensitive-adhesive layer and adhesively bonded to another article, for example a syringe which has been filled from the bottle.

BRIEF SUMMARY OF THE INVENTION

The multipart label according to the invention described in the following sections meets these requirements. It can be produced in a technically straightforward and cost-effective manner, makes available an information surface which can be, or is, fixed to the pack and is a number of times the size of the surface area which is available on the blister pack itself, and the label thus takes account both of EC guidelines and of national regulations. It thus provides a reliable solution to the problem of conveying to the user or consumer easily legible information in a clearly laid-out arrangement which is separated in a defined manner according to different languages, countries and classifications. The possibility of extending if required the amount of space available on the multipart label according to the invention makes available a flexible label concept which takes account of all customer-specific requirements and can thus be used advantageously in a large number of business sectors in trade, commerce and industry.

For example, the multipart labels according to the invention may be used particularly advantageously in the sector of the pharmaceutical and chemical industries for packaging medicinal products, for example pellets, tablets, capsules, ampoules, vials and ready-to-use syringes, or plant-protection agents, such as insecticide capsules and fertilizers in pellet or tablet form for straightforward and reliable measured regulation, or in the cosmetic sector, for example for denture-cleaning tablets, in the foodstuffs industry, for example for food supplements such as vitamin preparations and drink ampoules, in the metal industry, in tool manufacturing and mechanical engineering and the automotive industry for small parts and spares, in the household industry, e.g. for detergent and dishwasher tabs, and in all other sectors where, by means of the multipart label according to the invention, the intention is to provide comprehensive and clear information, which cannot be lost, on a primary or secondary pack.

The multipart label according to the invention, its features and its functions are described hereinbelow in particular in conjunction with a blister pack which is produced from a thermoforming sheet material by a deformation process and is closed by a covering sheet material once it has been filled. Of course, the labels according to the invention are also suitable, however, for labeling blister packs which have been produced in any other desired ways, and for all types of pack which have the functional features of the concept of the blister pack.

DETAILED DESCRIPTION OF THE INVENTION

Figure 1A:
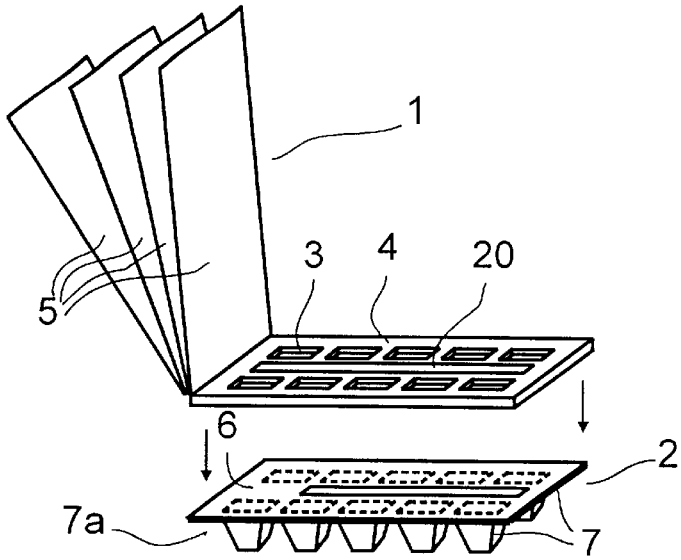
FIGS. 1*a* and 1*b* are schematic illustrations of the multipart label according to the present invention.
Figure 1B:
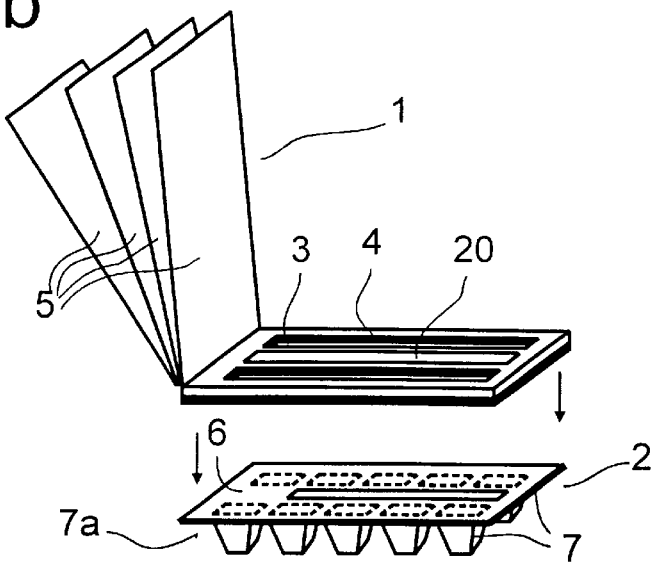

The present invention relates to the multipart label 1 which is illustrated schematically, and not to scale, in FIGS. 1*a* and 1*b* and is intended for providing information, in particular content-related details, on blister packs 2, having a text-carrying surface which is larger than the pack surfaces, comprising A) a sheet-like base element 4 which is provided with through-passages 3 and is suitable for fixing the label reliably on the pack which is to be labeled, or which is itself part of the pack, the through-passages of which are each assigned to one (FIG. 1*a*) or more (FIG. 1*b*) of the pack blisters provided for accommodating the pack contents, the minimum size of the through-passage opening being selected such that an individual object of the pack contents can pass through, and the maximum size of the free opening of the through-passages being selected such that at least webs remain therebetween to ensure that the base element is fixed reliably on the covering sheet material 6 (the "covering side") or on the thermoformed side 7*a* (the "blister side") of the thermoformed sheet material 7, and B) one or more sheet-like information carriers 5 which are fastened with swing action on the base element 4.

The rectangles which are illustrated by dashed lines on the blister packs 2 in FIGS. 1*a* and 1*b* mark the blister openings located beneath the covering sheet material 6. It is also possible to see in FIGS. 1*a* and 1*b* the zones 20 which are provided if desired in preferred embodiments of the label according to the invention and on which it is possible to specify label numbers and/or other essential information, e.g. about the pack contents or about a coding of the pack contents. Furthermore, FIG. 1*b* shows an adhesive coating 8 by means of which the base element can be fastened on the covering side of the blister pack. Moreover, by means of the downwardly directed arrows, FIGS. 1*a* and 1*b* illustrate the positioning and fastening of the label 1 on the blister pack 2.

There are various possible configurations for the through-passages provided in the base element. It is possible for the through-passages to be designed as open holes which are assigned to one, as illustrated in FIG. 1*a*, or more, as is illustrated in FIG. 1*b*, blisters of the blister pack. In this case, when the goods are removed from the blister, all that is required is for the thin covering sheet material to be pierced.

The removal can thus take place with minimum outlay in terms of force and the loading of the goods is identical to that during removal from a blister pack without labeling. This form is thus usually preferred for pressure-sensitive goods, e.g. relatively soft capsules.

Figure 2A:
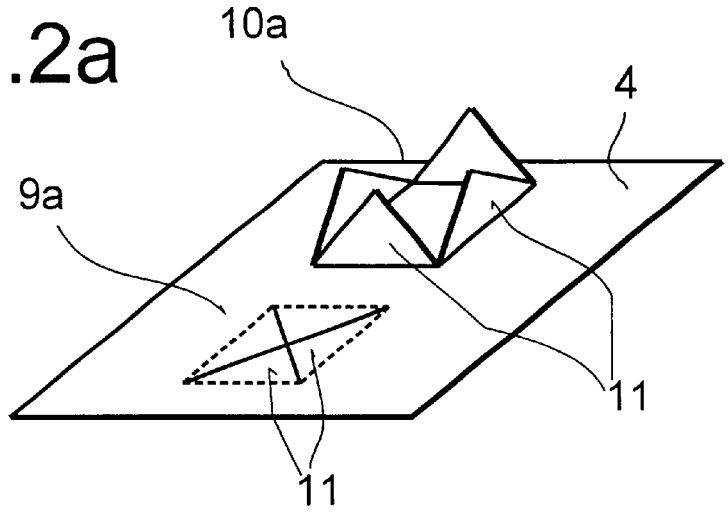
FIGS. 2*a*–2*c* show various possible configurations of the through-passages in the present invention.
Figure 2B:
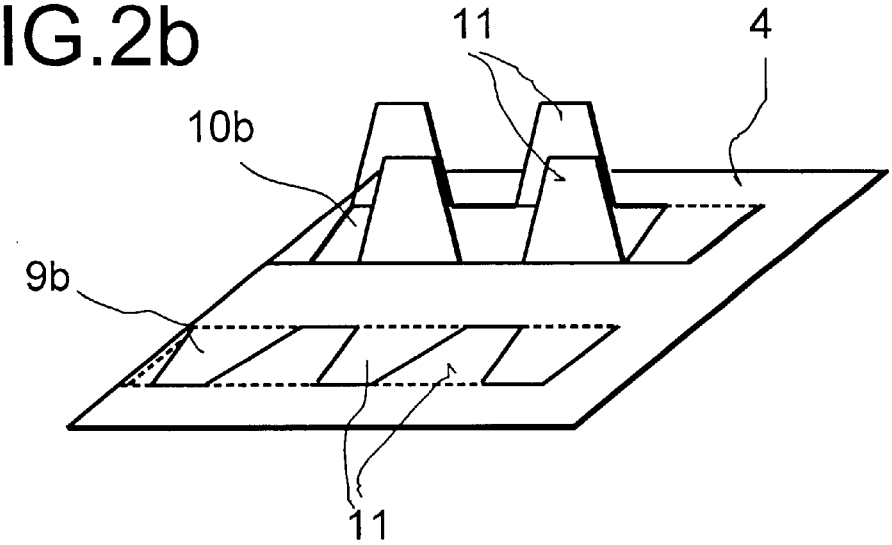
Figure 2C:
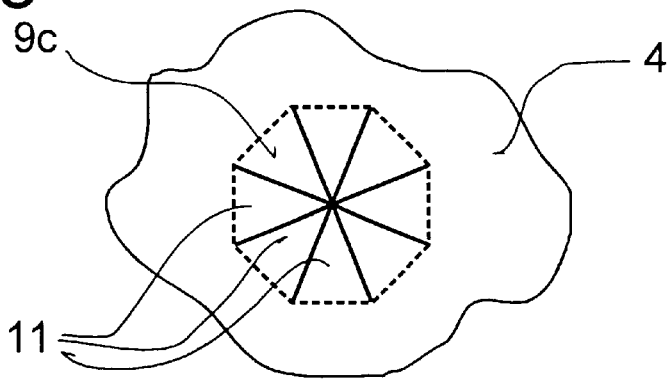

The through-passages may also be designed as cross-shaped, meandering or star-shaped slit formations as are illustrated schematically, and not to scale, in FIGS. 2*a* to 2*c*, or they may progress in some other appropriate, e.g. zigzag, form.

FIG. 2*a* shows an oblique plan view of part of a base element 4 with one cross-shaped through-passage slit formation, assigned to a blister of rectangular cross section, in the closed state 9*a*and one in the open form 10*a*, as is the case once the blister contents have been removed. The cross-shaped solid lines in 9*a*show the progression of the slits which bound the small surface-area elements 11, and the dashed lines mark the lines of inflection along which the surface-area elements 11 are bent open during opening of the through-passage.

FIG. 2*b* shows an oblique plan view of part of a base element 4 with one meandering through-passage slit formation, assigned to a plurality of blisters, in the closed state 9*b*and one in the open form 10*b*, as is the case once the blister content has been removed. As is marked in FIG. 2*a*, the solid meandering line marks the slit progression of the through-passage 9*b*, and the dashed line marks the line of inflection along which the surface-area elements 11 are bent open during opening of the through-passage.

FIG. 2*c* shows a vertical plan view of a fraction of a base element 4 with a star-shaped through-passage slit formation 9c assigned to a blister of round cross section. Of course, it is also possible for star-shaped through-passage slit formations to be assigned to blisters which do not have a round cross section.

The slits of the through-passage slit formations are preferably routed through the base material to the full extent and bound small surface-area elements 11 of the base material which are still connected to the main surface on one side. As is illustrated in FIGS. 2*a* and 2*b*, when goods are removed, the small surface-area elements 11 are bent upward when the covering sheet material is torn and thus expose the necessary through-passage. Notching, which does not pass through the base material to the full extent, perforations or other measures which weaken the material of the base element locally only to the extent where it can be torn open there function similarly. These embodiments are also to be understood by the term through-passage slit formation.

The advantage of the through-passage slit formations over open holes resides in the increase in the surface area which is available for connecting the base material to the surface of the blister pack.

In order for a base element which is not part of the pack itself to be fastened on the blister pack, use is made of a fastening means, also designated as coupling agent hereinbelow, which is symbolized in the figures by an adhesive layer 8. In principle, however, suitable coupling agents are all means which are suitable for such a purpose. Said coupling agent is selected in accordance with the requirements in practice, i.e. in accordance with the durability requirements, the necessary strength of the coupling connection, the long-term stability, the tolerable production costs for the label and the possible handling by the user and the packaging designs.

The coupling agent may be provided on the coupling side of the base element, or fixing may take place using separate commercially available fastening means or fastening means integrated in the pack.

Examples of separate, commercially available fastening means by which the base element can be fastened on the pack in a manner known per se are staples, rivets or adhesive. Coupling agents which are a constituent part of the pack may be in the form of grooves into which a stiff base element can be pushed, they may be elastic anchors which engage in, and snap into, openings of the base element, or they may be constituted by an adhesive layer, e.g. a contact-adhesive layer, applied to a pack surface. Examples of coupling agents which are a constituent part of the label according to the invention are likewise formed by an adhesive layer or elastic, hook-like anchors which snap into openings or borders of the pack.

The base element is preferably provided on the coupling side, over part of the surface area or the entire surface area, with an adhesive-bonding layer which is suitable for fixing the label reliably on the pack which is to be labeled. Possible adhesives are those which only develop their adhesive force following a pretreatment, e.g. following moistening with a liquid, water or a solvent, or else those which readily adhere to a pack surface pretreated, if appropriate, in a corresponding manner.

Adhesive-bonding layers which adhere immediately, referred to as a contact-adhesive layer hereinbelow, are expediently covered over by a peel-off protective sheet material in order to avoid the situation where the label accidentally sticks to equipment and other articles.

A further possibility of fixing the base element on a surface of the pack arises if said surface and the base element consist of a thermoplastic material. In this case, the base element can be welded to said pack surface over the entire surface area or at certain points.

Surface-area size and shape of the base element depend on the dimensions of the surfaces which are available on the pack and are suitable for providing the label.

Provided that it is desired, for specific reasons described hereinbelow, for the base element to form an overhang at one or two pack edges (see FIGS. 3, 4*b*, 5*a*, 5*b*, 6, 12), the base element is preferably dimensioned such that, rather than projecting beyond the surface on which it is to be provided, it terminates flush with the edges of the pack or covers only part of the surface area. Although a maximum coupling force can be achieved when the label covers an entire surface of the pack, in particular the largest surface area, there may be specific conditions under which partial covering is sufficient or preferred.

Although it is thus often expedient for the size and shape of the base element to correspond to the size and shape of the pack surface which is to be labeled, it is occasionally more advantageous for them to differ. Thus, it may be advantageous if the base element projects beyond the pack surface on which it is to be fixed, an overhang surface 12 being formed in the process. As is explained hereinbelow and illustrated in FIGS. 3, 5*a*, 5*b*, 6*a*, 6*b* and 7, such an overhang may be advantageous for a particular configuration of the label according to the invention and/or for fastening the information carriers on the base element.

Figure 3:
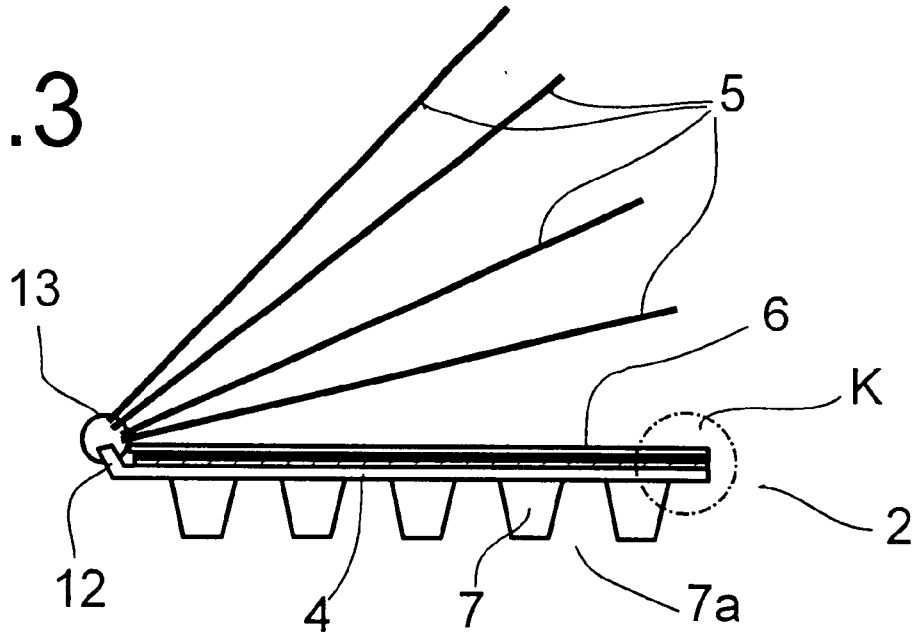
FIGS. 3 and 4*a*–15*b* show various embodiments of the present invention.
Figure 3A:
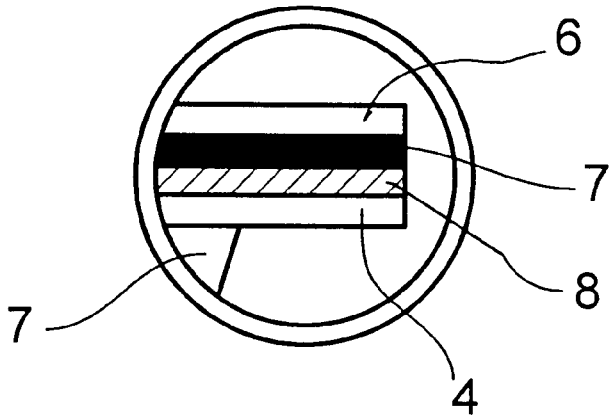
FIG. 3*a* shows an enlargement of a portion of the embodiment depicted in FIG. 3.

The base element, by way of which the label according to the invention is attached to the blister pack, may—as is illustrated in FIG. 1—be fixed on the covering to sheet material 6 of the blister pack, but it may also be fastened on the thermoformed side, the "blister side" 7. In the latter case, the through-passages are arranged and dimensioned such that the blisters can be guided through them. The webs between the through-passages are then fixed on the essentially planar surface regions of the thermoformed sheet material which are provided between the blisters. Such an arrangement in which the base element 4 is fixed on the thermoformed side 7*a* of the blister pack 2, e.g. by means of an adhesive layer 8, is shown in FIGS. 3 and 3*a*, which illustrates an enlargement of the encircled part (K) of FIG. 3. In this exemplary illustration, the information carriers 5 are fastened (articulated) on an overhang 12 of the base element 4 by means of a helix 13, shown as a circle, and can be deposited as a stack on the covering sheet material 6. The enlargement illustrated in FIG. 3*a* clearly shows the layer sequence which is present in this design (from bottom to top): base element 4, coupling layer 8, thermoformed sheet material 7 and covering sheet material 6.

In such a design, the information-carrier stack swung up, the removal of the pack contents is obviously not obstructed in any way by the base element.

However, even when the base element is fixed on the covering side of the blister pack, the removal of the packed objects has to be possible. The through-passages therefore have to open at least to a size which allows the objects to pass through them. For spherical objects, this means that the through-passage can be opened at least to the size of the object diameter. With non-spherical objects, the necessary through-passage opening depends on the position of the objects in relation to the covering. The optimum position of the objects would be that in which their projection onto the covering forms the smallest possible surface area. In principle, then, through-passages in the base element which have said free opening or can be opened to give this free opening are sufficient for removing the objects from the blisters.

However, this presupposes that a non-spherical object—these forming the majority of packed objects—is first of all rotated into the optimum removal position in the blister. This makes the removal more difficult and, in some cases, is just not possible.

If the intention is to achieve the situation where essentially unobstructed through-passage of an individual object of the pack content is to be possible, then the cross section to which the through-passages can be opened expediently corresponds essentially to the largest cross section of the goods which are to be removed.

Even with this dimensioning, there may still occasionally be cases where the objects catch or tilt at the edges of the through-passages. This can be avoided if the cross section of the free opening of the through-passages corresponds to the largest inner cross section of the blisters of the pack.

A base element is provided on the covering side such that its through-passages coincide with one or more of the blister openings covered by pierceable sheet material, to the extent that removal of the packed goods is possible.

The information carriers fastened (articulated) with swing action on the base element are sheet-like blanks of which the surface area provided for accommodating the information expediently corresponds in shape and size to the dimensions of the pack surface which is to be labeled, and thus also usually to those of the base element. Provided that the information carriers 5 are not to be fastened on an edge of the base element 4, they have, in addition to the information region, designated 14 in FIGS. 4*a*, 4*b*, 5*a* and 5*b*, a fastening region which is designated 15*b*, a flexible connection 16 symbolized by small circles being provided if necessary between said two regions.

The information surfaces of the information carriers may be prepared, if desired, for example by producing surfaces on which it is possible to write or print, which are reflective or magnetizable or are suitable in some other way for storing and/or visualizing data, for the purpose of accommodating corresponding, even optoelectronic, information, or they may be prepared for the provision of an information-containing label. Finally, they may also themselves be provided with an, if appropriate, sheet-material-protected coupling layer which makes it possible for any desired information-carrying labels which do not have any application of gum or contact adhesive to be fastened on the information surfaces of the information carriers.

It is also possible for the base-element webs remaining between the through-passages to be prepared in the same way for accommodating information.

An edge of the base element or a sub-surface of the base element which is not located over blister openings and thus does not have to have through-passages which are to be opened or are opened, referred to as fastening surface hereinbelow, may serve for fastening the information carriers.

The fastening surface of the base element usually only takes up a small section of the base-element surface area, said section expediently being located parallel to an edge, preferably a short edge, of the base element.

Figure 4A:
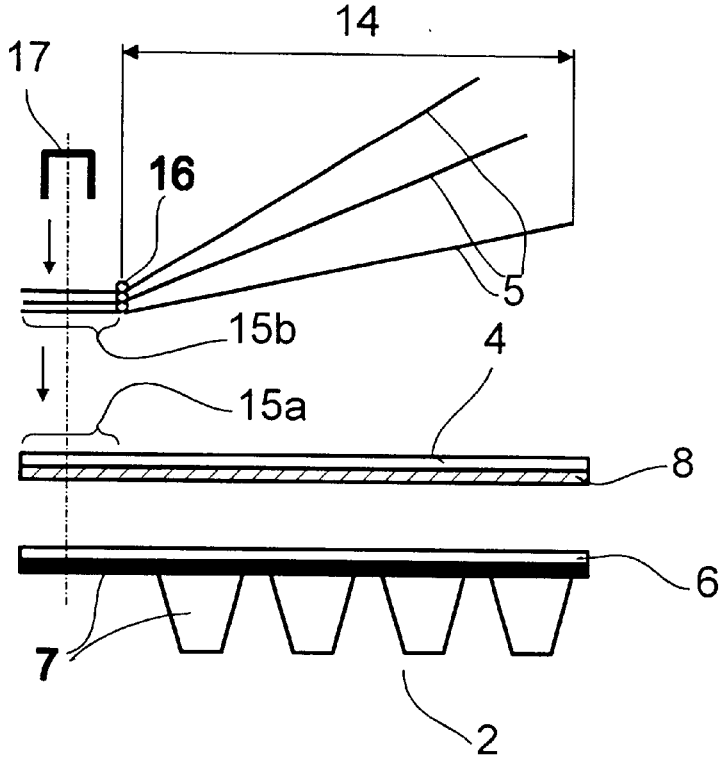

In a blister pack in which the thermoformed sheet material has only been deformed to give blister-like depressions over part of its surface area, the fastening region of the base element may be located over the non-thermoformed surface area of the thermoformed sheet material. Blister packs of this type are used for specific cases where, for example, despite the use of a standard thermoforming mold, only a small number of blisters are desired, with the result that a non-deformed surface region of the sheet material remains. FIG. 4*a* illustrates, in the manner of an exploded illustration, a side view, schematically and not to scale, of a blister pack 2 comprising the thermoformed sheet material 7, only a sub-surface of which has been deformed to give blisters, and the covering sheet material 6, which is fastened above said thermoformed sheet material and covers the entire surface area of the thermoformed sheet material in this example, but, of course, could also be provided merely over the blister region. The base element 4 of the label according to the invention is fixed on the covering sheet material 6 by means of the adhesive layer 8, the base element in this exemplary illustration likewise covering the entire surface area of the thermoformed sheet material. The fastening surface 15*a* of the base element is located above the non-deformed part of the thermoformed sheet material 7. That size of the base element which is illustrated here is not compulsory. It would be quite possible for it to be smaller than the surface area of the thermoformed sheet material, as long as its surface area is sufficient to accommodate the necessary information and to give the label on the pack a secure grip.

The information carriers 5, which are illustrated above the base element, are positioned such that, when lowered in the direction of the arrow, they come into contact with the fastening surface 15*a* by way of their fastening surfaces 15*b* and can be fastened on the base element there with the aid of a fastening means, symbolized by the staple 17 in FIG. 5.

Figure 5A:
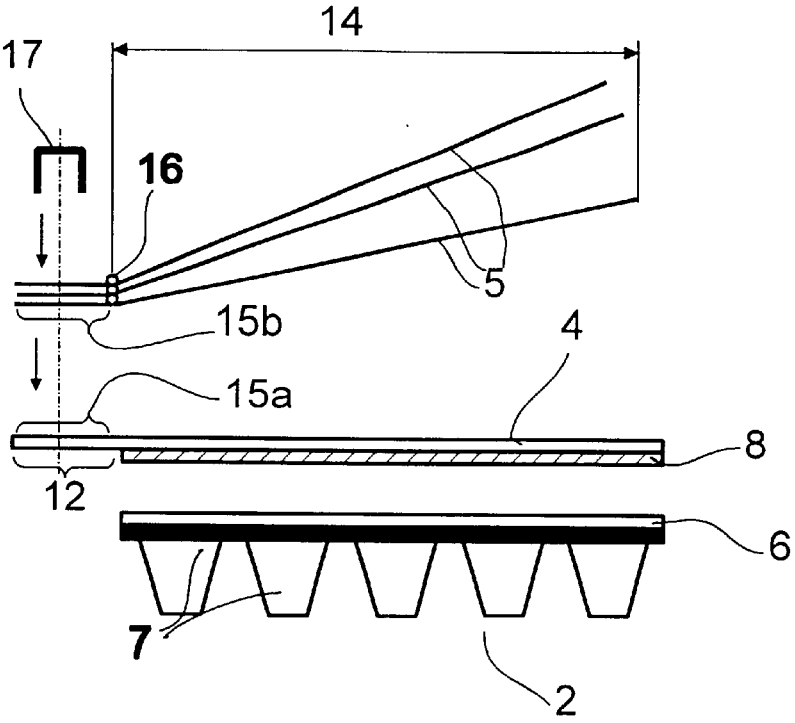

In a blister pack in which the entire surface area of the thermoformed sheet material has blister-like deformations, it is possible to use as the fastening surface an overhang of the base element, which extends beyond the pack surface on which the label is to be fastened. The overhang may expediently be a continuation of a base element which has been cut to size such that only part of its surface area serves for fastening on the blister pack and is provided with through-passages. FIG. 5*a* illustrates, likewise in the manner of an exploded illustration, a side view, schematically and not to scale, of a blister pack 2 comprising the thermoformed sheet material 7, the entire available surface area of which has been deformed to give blisters, and the covering sheet material 6, which is fastened above said thermoformed sheet material. The base element 4 of the label according to the invention is fixed on the covering sheet material 6 by means of the adhesive layer 8, the base element having the overhang 12 which extends beyond the surface of the thermoformed sheet material. In this case, the fastening surface 15*a* of the base element is located on the overhang 12. In this embodiment too, that size of the base element which is illustrated is not compulsory. It would also be quite possible for it to be smaller than the surface area of the thermoformed sheet material, as long as its surface area is sufficient to accommodate the necessary information and to give the label on the pack a secure grip.

The information carriers 5, which are illustrated above the base element, are positioned such that, when lowered in the direction of the arrow, they come into contact with the fastening surface 15*a* by way of their fastening surfaces 15*b* and can be fastened on the base element there with the aid of a fastening means, symbolized by the staple 17 in FIG. 5.

FIGS. 4*a*, 4*b*, 5*a* and 5*b* also illustrate the information regions 14 of the information carriers. Located between these and the fastening surfaces 15*b* are linear zones which have been made flexible, symbolized by the small circles 16, and allow the information carriers to be swung up.

Figure 4B:
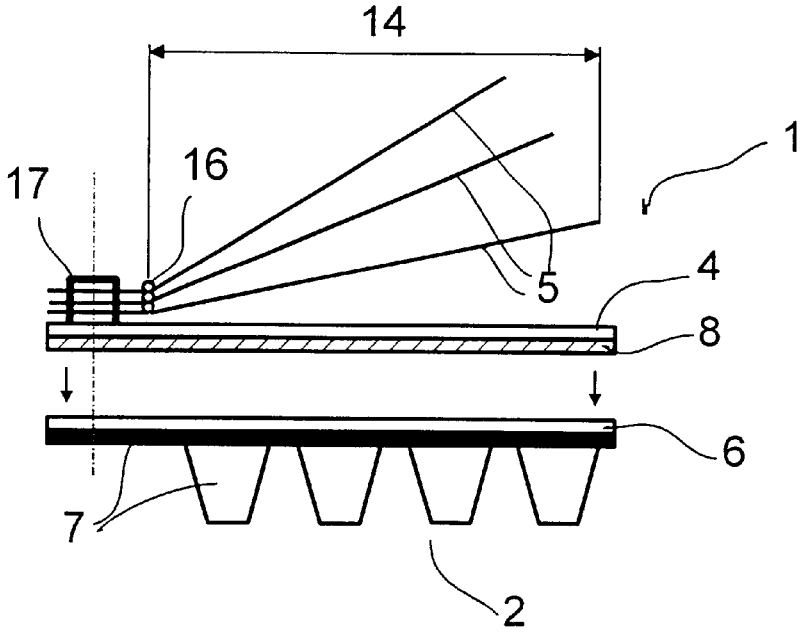
Figure 5B:
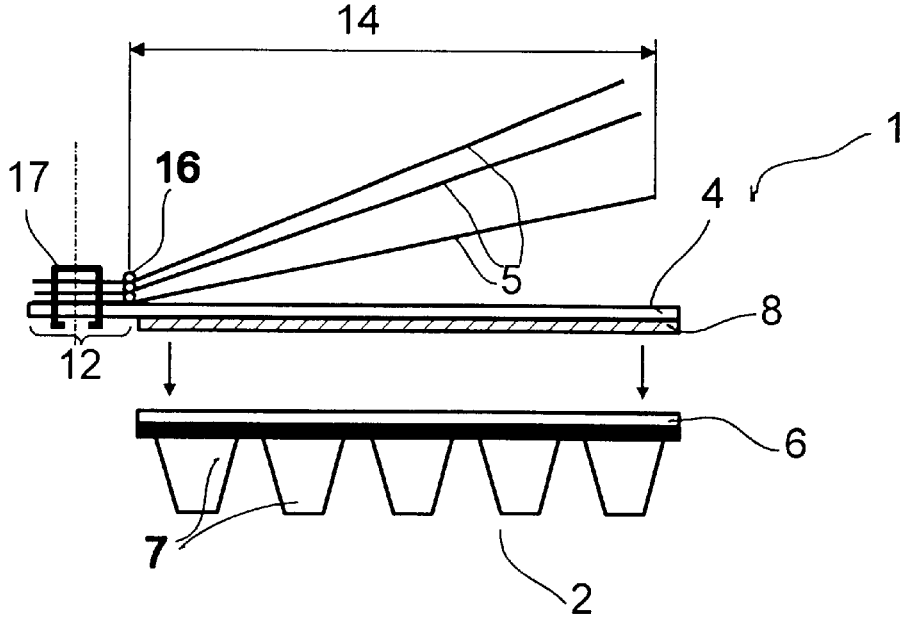

FIGS. 4*b* and 5*b* illustrate the labels 1 according to the invention which are produced by the information carriers 5 shown in FIGS. 4*a* and 5*a* being joined together and connected to the base elements 4.

Of course, the various possible ways of fastening the information carriers on the base element are always selected appropriately with consideration of the pack design—fully independently of the production process of the pack.

Figure 6A:
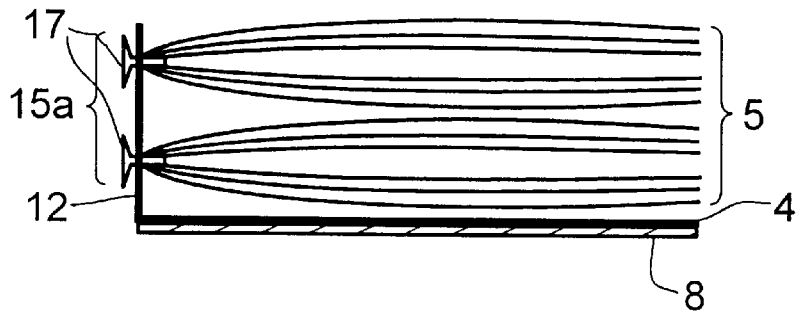
Figure 6B:
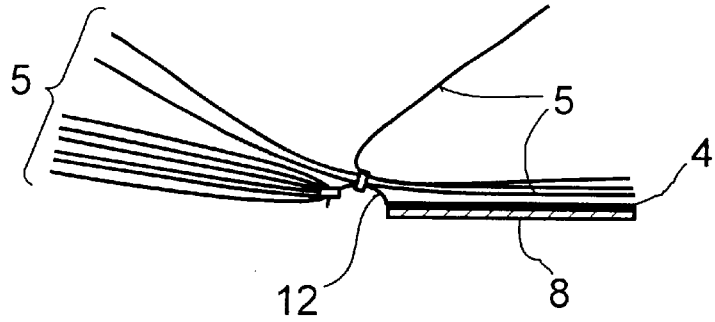

There are various other possible ways of fastening the information carriers on the overhang surface of the base element. FIG. 6*a* shows, schematically, a side view of an embodiment of the label according to the invention in which the information carriers 5 are fastened on the overhang 12 of the base element 4 in the manner of bookbinding and the base element is provided with an adhesive layer 8. The information-carrier stack is then produced by the information-carrier strips folded in the middle and located one above the other. It is particularly advantageous with this method of fastening if the overhang has a particularly high level of flexibility, because it is then particularly easy for the information-carrier sheets to be opened (see FIG. 6*b*).

Figure 7:
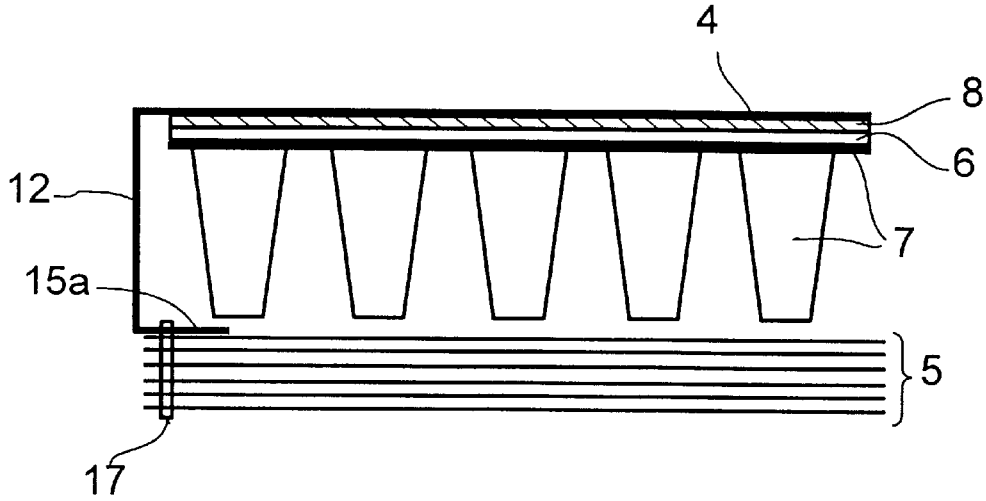

It may occasionally be advantageous if, as is illustrated schematically in a side view in FIG. 7, the information carriers 5 are deposited on the blister side of the blister pack 2, the blister side being located opposite the side connected to the base element 4. This structure can be realized if the length of the overhang surface 12 corresponds to the sum of the height of the pack and the width of the fastening surface 15. The fastening surface of the base element is then expediently located at the end of the overhang surface, which projects beyond the pack surface.

The base element and the information carriers may be connected in various ways. It is thus possible for the fastening surfaces of the information carriers to be connected rigidly to the fastening surface of the base element by any desired known fastening means acting between them—symbolized by the staple 17 in FIGS. 4*a*, 4*b*, 5*a* and 5*b*—and for the information surfaces of the information carriers to be articulated with swing action on the fastening surfaces of the information carriers.

This means that, with this method of fastening the information carriers on the base element, the flexible connection 16 has to be provided between the fastening surfaces 15*b* of the information carriers and the information surfaces 14 of the information carriers.

If only a small amount of information is required, it is possible for just one information carrier to be fastened on the base element. Such a single information carrier may also be formed in a very straightforward manner from a base-element extension folded back at a flexible line of inflection.

However, the significant advantages of the label according to the invention usually only come to the fore when a very large amount of information, which cannot be accommodated on a single information carrier, has to be given.

It is thus usually the case that a multiplicity N of information carriers are connected to the base element. It is usually the case that 5 to 30 information carriers are fastened on a base element (N=5 to 30). Depending on the amount of space required at any one time, however, it is also possible for N to be smaller or larger. The N information carriers are then fixed as a stack on the fastening region of the base element by way of fastening surfaces located one above the other.

Of course, the feature of the information carriers being fastened on the base element also covers those stacked information carriers in which only the lowermost information carrier is attached directly to the base element, and all the information carriers located thereabove are fastened on the base element indirectly via the information-carrier layers located therebetween. It also covers that embodiment of the label according to the invention which is illustrated in FIG. 6*a*, in which information-carrier strips which are folded in the middle are fastened on an overhang of the base element in the manner of bookbinding. The information-carrier stack is then produced by the information-carrier strips folded in the middle and located one above the other.

The fastening between the fastening surfaces of the information carriers and the fastening surface of the base element can take place using all known connecting elements. Preferred, known mechanical fastening means which may be used are one or more staples or rivets by means of which the fastening surfaces of the stacked information carriers are fastened on one another and on the base element. Sewing constitutes another preferred mechanical fastening method, it being possible for the sewing material used to be monofilament or multifilament threads or else metal wires. However, it is also possible for the fastening means used to be an adhesive, preferably a contact adhesive, by means of which the fastening surfaces of the stacked information carriers are adhesively bonded to one another and to the fastening element. Particularly advantageous are, for example, information carriers which are provided on the fastening surface with a coating of adhesive, if appropriate protected by sheet material. Depending on the machinery at the label manufacturer's, such material may provide advantages in the production of an information-carrier stack on the fastening region of the base element.

The free edges of the fastening surfaces may be glued to one another by means of adhesive in order additionally to afford higher strength, e.g. by stapling, and to minimize the opening of the sheets in the fastening region.

The information-carrier stack may also be formed by a strip of the information-carrier material folded in zigzag form, said material being fastened on an edge or on the fastening region of the base element. Particular advantages, which are described hereinbelow, are achieved if the zigzag-folded strip is a folded-back, strip-like extension of the base element.

Figure 8:
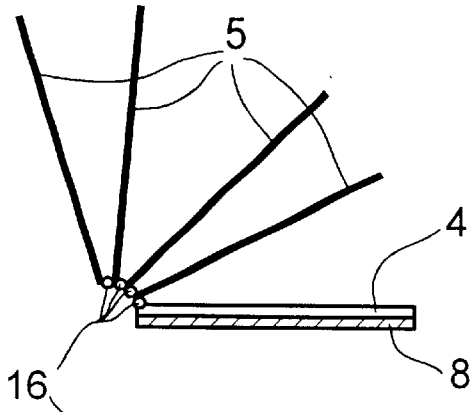
Figure 9:
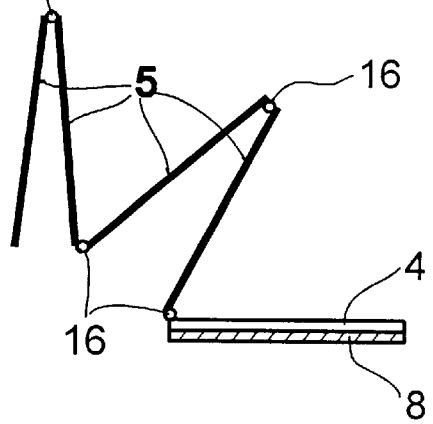

The swing-action fastening of the information carriers on an edge of the base element or an edge of an overhang of the base element is particular expedient, uncomplicated and advantageous. If the width of the overhang is selected to be equal to the thickness of the pack, this results in the abovementioned advantage of it being possible for the information-carrier stack to be deposited on the blister side of the blister pack. The fastening on the edge expediently takes place such that the first, lowermost information carrier is fastened (articulated) directly on the base element 4 or an overhang of the base element, and each further information carrier 5 located thereabove is then fastened (articulated) on the preceding information carrier. FIGS. 8 and 9 illustrate, in a side view, how this can be achieved in two different ways: the higher information carriers may be fastened in each case on that edge of the information carrier located therebeneath by means of which the latter is fastened on its predecessor or on the base element (FIG. 8), or the higher information carriers may be articulated in each case on the free edge of the predecessor (FIG. 9). The flexible fastening (articulation) is also symbolized by the circles 16 in FIGS. 8 and 9.

Figure 10A:
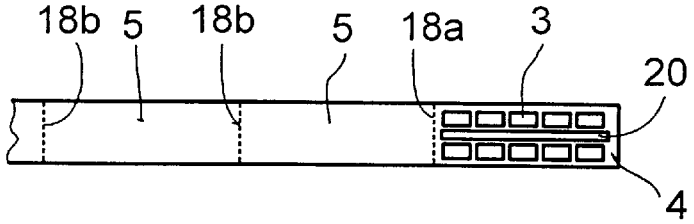
Figure 10B:
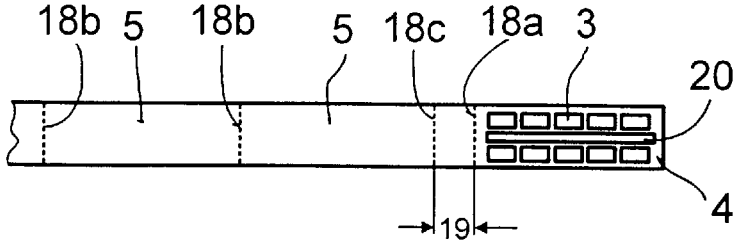

In the simplest case, the method of fastening is realized by the base element and the information carriers being cut out of a continuous strip of a suitable sheet-like material of sufficient strength. In this case, the width of the strip corresponds to the width of the pack, and the length is expediently a whole-numbered multiple of the pack length and, if desired, an added length of the magnitude of the pack thickness. FIG. 10*a* illustrates a vertical plan view of part of such a strip and of the strip handling described hereinbelow. A section of said strip, usually the first section, is provided, e.g. by punching or notching, with the through-passages 3 necessary for the base element. At the end of the base element, the strip is made flexible by suitable measures along a line in the direction transverse to the longitudinal direction—illustrated by the dashed line 18a in FIG. 10*a*—with the result that it can be swung against the base element along said line. A flexible transverse line (dashed lines 18*b*) is subsequently produced in each case at a distance equal to the pack length, this producing a multiplicity of information-carrier surfaces. If a distance 19 equal to the pack thickness is desired between the base element and the information-carrier stack, as is illustrated in FIG. 10*b*, the strip is additionally made flexible, at said distance 19 from the line 18*a*, at 18*c* in the direction transverse to its length, and the flexible transverse lines 18*b* then follow on from this as described above.

It is then possible for the information-carrier surfaces to be folded together in zigzag form to give an information-carrier stack, this producing the embodiment of FIG. 9, or it is possible for in each case two successive information-carrier sections to be adhesively bonded by way of the surfaces which are directed toward one another, this producing the embodiment of FIG. 8. The embodiment of FIG. 8 is particularly manageable and, by virtue of in each case two material layers being laminated one upon the other, also particularly robust. If a section equal to the length of the pack thickness has been incorporated between the base element and the first information-carrier surface, then the information-carrier stack can be deposited on the blister side (FIG. 7), otherwise it is deposited on the covering side. The text provided is to be adapted correspondingly.

Alternatively, but involving considerably more outlay in technical terms, it is possible to use as fastening means one or more loops which are fastened or integrated in the base element, engage in border holes in the fastening surfaces of the information carriers and in which the information carriers can be turned in the manner of ring-binder pages. It is similarly possible to use as fastening means a helix which is fastened in the base element, engages in border holes in the fastening surfaces of the information carriers and in which the information carriers can be turned in the manner of spiral-bound pages.

With this method of fastening, there is no need for any flexible connection between the fastening surfaces and the information surfaces of the information carriers.

Figure 11:
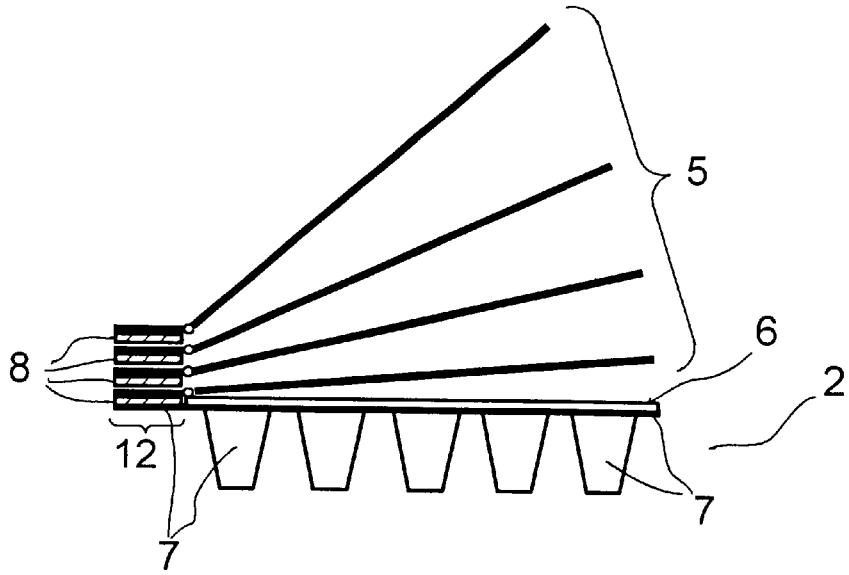

The base element may also be part of the blister pack 2 itself. In principle, both the thermoformed sheet material, in which the blister-like depressions are formed, and the covering sheet material may assume the function of the base element. For fastening information carriers, it is possible to provide, both on the thermoformed sheet material and on the covering sheet material, a sheet-material extension which corresponds to the overhang of a base element and on which the information carriers are fixed by way of their fastening surfaces in one of the ways described above. FIG. 11 illustrates, schematically, a base element 4 which is formed from the thermoformed sheet material 7 of the blister pack 2 and on the overhang 12 of which the information carriers 5 are fixed by means of adhesive layers 8. The blister openings are closed by the covering sheet material 6.

Analogously, it is possible to utilize the covering sheet material 6—if appropriate following reinforcement of the fastening surface or of the overhang—as the base element. It goes without saying that, in this case, the base element must not have any through-passages.

The information carriers do not have to be provided on an overhang of the thermoformed sheet material or of the covering sheet material; it is possible for them to be fastened (articulated) on an edge of the sheet material. The articulation on an edge may be executed in the same way as has already been described above for separate base elements. It is also particularly advantageous here if the information carriers are formed from a zigzag-folded continuation of the thermoformed sheet material or of the covering sheet material. The information region of the information carriers may if desired, as has been described above for separate base elements, be prepared for accommodating corresponding information, or it may be provided with an adhesive-compatible surface for the provision of a self-adhesive, information-containing label.

That part of the packaging material which is provided as a fastening surface may, as has been described above, be prepared, by a coating of adhesive, for an information carrier, or a stack of information carriers, to be adhesively bonded thereto. The other above described fastening methods for the information-carrier stack, such as riveting, stapling or sewing, are also practicable. If necessary, in particular if the covering sheet material is to perform the function of the base element, the tear resistance, in particular the resistance to initial tearing, tearing out and tear propagation, may be increased, e.g. by the application of resin or backing with nonwoven fabrics, sheet materials or paperboard, in order to increase the strength of the connection between the fastening region and the information-carrier assembly.

As with the base element, it is usually expedient if the size of the information surfaces of the information carriers corresponds to the size of the pack surface on which the label according to the information is fixed. In exceptional cases, the fastening surface is coordinated with the method of fastening and with the size of the fastening surface provided on the base element. The selection between the various possible designs takes place in accordance with expediency criteria in these cases.

In principle, the base element and the information carriers may consist of the same or different known, sheet-like materials. The selection of the material depends on the functions assigned to the components of the label and on the mechanical strength required, e.g. the necessary tear resistance and resistance to aging. A specific requirement which the material of the base element has to meet is that it is suitable for producing fixed and permanent adhesive connections to packaging materials, but that it is also suitable, between the through-passages, for being provided with text or for storing information in some other way, e.g. by printing, stamping, punching or burning in, preferably for being provided with print or having text-carrying labels adhesively bonded to it. The same applies to the material of the information carriers. It is also necessary for this, on the one hand, to allow satisfactory fastening on the base element and, on the other hand, to be suitable for straightforward, permanent storage of information on both sides of the information surface.

The materials should, not least, allow straightforward production and the price of materials should not be prohibitive.

Examples of materials of which the base elements and the information carriers may consist are paper, paperboard, in particular reinforced with synthetic resin or long fibers, nonwoven fabric, in particular resin-bonded or autogeneously bonded sprungbonded fabrics, plastic sheet material, metal foil or composites made of two or more of these materials.

If the base element and/or the information carriers consist of a single-layer material, it is occasionally the case that, rather than satisfying all requirements, e.g. in terms of stability and information-storage capacity, to the maximum extent, a compromise between the individual requirements is necessary. However, it is usually possible for the requirements to which a label according to the invention may reasonably be subject also to be satisfied using a single-layer material.

If greater demands are made, or for specific configurations of the label according to the invention, it is advantageous if the base element and/or the information carriers consist of a multi-layer material. It is possible to achieve particular advantages for producing and using the labels, for example, by combining different materials for a carrying layer, a storage layer, for a coupling layer and/or protective layer.

An example which may be mentioned is an information carrier consisting of a material which is self-adhesive on one or both sides and is coated with a peel-off protective sheet material.

Once the protective sheet material has been removed from the information surfaces, it is possible for text-carrying labels to be adhesively bonded to such an information carrier, it not being necessary for the labels themselves to have any adhesive-bonding surface. It is then possible for the protective sheet materials in the fastening region to be removed before the combining operation, and for the information carriers to be adhesively bonded to give the stack. Such a material thus results in cost-effective production of the multipart labels according to the invention. A further example is a base element which has an overhang to which, as is illustrated in FIG. 5*a*, a multiplicity of information carriers are stapled and which is stiffened, e.g. resin-stiffened, in the coupling and information region and is highly flexible in the overhang region. The opening of the information-carrier sheets, as is illustrated in FIG. 5*b*, is made much easier by such a material combination.

A material which is particularly well suited for producing the preferred embodiment of the label according to the invention which is illustrated in FIG. 8 is a sheet-like structure, for example made of paper, sheet material or nonwoven fabric, which is coated with an adhesive at least on one side and, if said adhesive is a contact adhesive, is covered with a peel-off protective sheet material. A strip of such a material may be provided, in the region envisaged as base element, with through-passages and, over the rest of the length, with locations of inflection at distances equal to the information-carrier length. The protective sheet materials are then peeled off from the adhesive along the strip length provided for information carriers and in each case two successive information carriers are adhesively bonded to one another by way of the adhesive-bonding surfaces. This produces a label according to the invention from FIG. 8 in an extremely cost-effective manner.

The information may be provided subsequently or before removal of the adhesive-protecting sheet material. Alternatively, it is also possible to use a material which is coated with adhesive on both sides. On one side, the procedure is as has been described above, and from the other side the protective sheet materials are only peeled off when labels with the information are to be adhesively bonded to the information carriers. In this case, it is possible to use labels which do not have any application of adhesive.

An essential feature of the labels according to the invention is that the information carriers are fastened (articulated) with swing action on the base element. If the fastening does not, as has been described above inter alia, take place via a flexible connection between an edge of the information carrier and an edge of the base element or an edge of the preceding information carrier, or by means of loops or helixes which engage in corresponding holes of the fastening region of the information carriers, it is necessary to have, between the fastening surface and the information surface of the information carriers, a connection which allows the information-carrier sheets to be opened, i.e. which makes it possible to establish any desired small angle between the two surfaces. It should be possible for this change in angle to take place within the shortest possible distance, in order that it is possible to see the entire information surface area of the information carrier when the sheets are opened, with the result that the information can be read without difficulty. In the simplest case, which is the preferred case, the information carrier consists of a material of such a flexibility, e.g. paper or nonwoven fabric, that the sheets of the information-carrier stack can be opened without difficulty in the same way as a book. In a narrow region between the fastening surface and the information surface of the information carrier, a more or less sharp bend or line of inflection then forms easily when the sheets of the information-carrier stack are opened, said bend or line making it possible to view the entire information surface area. There is no need in this case for any specific measures which make it possible to establish between the fastening and information surfaces an angle which is necessary for the sheets of the information-carrier stack to be opened without obstruction.

If, in contrast, the information carriers of an information-carrier stack consist of materials which are inherently less flexible, e.g. paperboards or resin-reinforced papers, then such a straightforward design is no longer possible because, when the attempt is made to open the sheets of the information-carrier stack, an excessively large radius of curvature forms in the information surfaces, said curvature making it very difficult, or impossible, to read the information, or tears or ruptures form in the information carriers, which likewise may result in a loss of important information. In this case, it is thus necessary to take design measures which make it possible, despite the stiffness of the material, for an angle which is necessary for opening the sheets of the information-carrier stack to be established between the fastening and information surfaces of the information carriers, it being the intention for the material to curve over the shortest possible strip-like section between the fastening and information surfaces.

The requirement can be satisfied, in principle, by any known design which functions in a hinge-like manner. An expedient, practicable and financially viable solution consists in a narrow region with a particularly high level of flexibility being provided on the straight boundary line between surfaces which have to be inclined in relation to one another, said narrow region ensuring the necessary flexible connection between the surfaces. A precondition for this is that the flexible connection is produced by an attachment element made of a material which is flexible with a low level of fatigue.

For example, the flexible connection between the surfaces may be produced by fibers which extend between said surfaces and are firmly incorporated therein. These may be fibers of the fiber material from which the information carriers and the base element are produced, or they may be reinforcement fibers which are incorporated non-releasably in the sheet-like material at least in the region of the line of inflection.

If the surfaces which are to be inclined in relation to one another comprise a continuous piece of a suitable material, the flexible connection may be formed by a line, between the sub-regions of the material, at which inflection can take place with a low level of fatigue. Such a pre-planned line of inflection may be achieved by a specific change in the material structure which is restricted to the narrow region of inflection and results in an increase in flexibility. For example, the line of inflection may be pre-formed by the material being inflected a number of times along the planned line.

The specific increase in flexibility, however, may also be realized by a linear reduction in material thickness, provided, for example, by scoring, or by a reduction in the material mass along the line of inflection, said reduction being provided by linear perforation.

If the material comprises two or more layers of different flexibility, then the layers of lower flexibility may be slit or perforated along the envisaged line of inflection.

Figure 12:
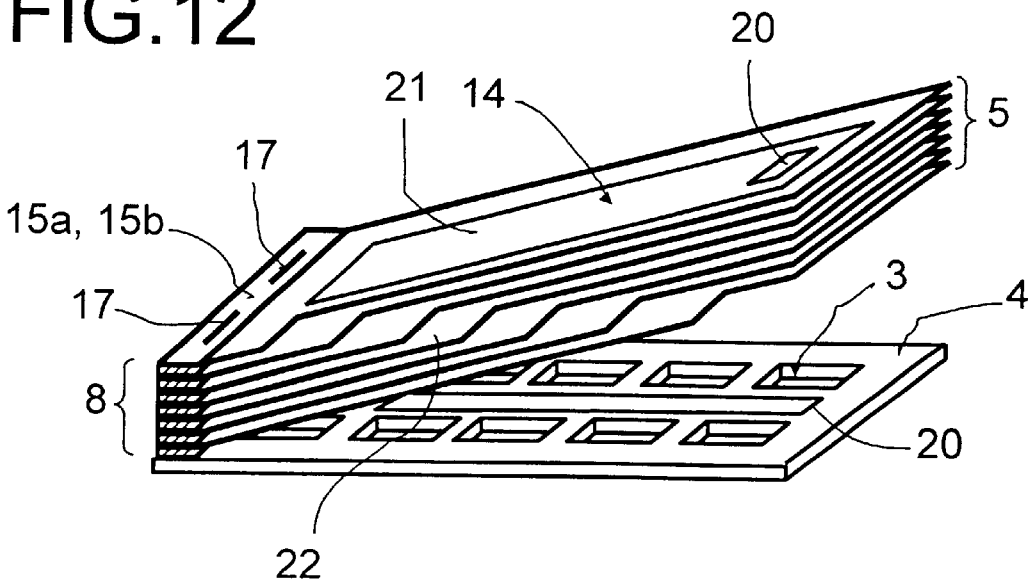

As is illustrated in FIG. 12, information may be provided on the label according to the invention both on a sufficiently wide zone 20 between the through-passages 3 of the base element 4 and on the two sides of the information region 14 of the information carriers 5.

A zone 20 for a label identification symbol is preferably reserved both on the base element and on the top side of the uppermost information carrier. It is also possible for a zone for a label identification symbol to be reserved on each information-carrier side. Such a symbol makes possible error-free, even automatic labeling of packs which have the same identification symbol. The identification symbol may be, for example, a combination of letters and/or numbers or an icon which is easily identifiable, if appropriate also by automatic machines.

If possible, in addition to the label identification symbol, essential basic and safety information, in particular identification information, on the pack contents is provided, in an easily readable world language, on the webs of the base element.

This essential basic information is also preferably provided on the top side of the uppermost information carrier fastened (articulated) on the base element.

In view of the English language being widely used and easy to read, it is preferred for the basic and identification information to be provided in this language.

All the desired information may be provided on the information surfaces of the multipart label according to the invention by writing, printing, stamping, punching or burning in using plain text or in the form of digital/optical information, e.g. a barcode, or the base element and information carriers may have labels 21 on which said information is recorded adhesively bonded to the information surfaces. If the information carriers have adhesive-coated information surfaces protected by sheet material, then it is possible to use adhesive-free labels, otherwise adhesive labels are used.

On surfaces which are prepared for magnetic information storage, it is also possible for the information to be stored magnetically. With a suitable selection of the carrier material, it is also possible simultaneously to have magnetic and printed reproduction of the information on the information carrier.

The large amount of space available on the label according to the invention makes it possible for all the necessary and/or desired information to be set down in a sorted form in the desired manner. It is thus possible for the individual information carriers to be provided with information selected on a country-specific basis. The search for information sorted in this way is facilitated particularly if an index 22 is cut into at least one edge of the information-carrier stack. It is also possible for the other edges, in particular the second longitudinal edge of the information-carrier stack, to have an index. This is particularly advantageous when, for example, the front sides of the information carriers bear information ordered on a country-specific basis and, in contrast, the rear sides have this information sorted by subject. It is then possible to search on a country-related basis in one index and by subject in the other index. A further possibility of searching on a specific basis in accordance with different criteria is to provide an index strip which is printed differently, in accordance with the different sorting categories, on the front side and on the rear side.

An index may also be produced by information carriers which relate to different sorting features being of different lengths or widths, while all the information carriers which relate to the same sorting features are of essentially the same dimensions. The differences in dimensions are selected such that the resulting graduations are sufficient for accommodating the keywords or details of contents.

If permitted by the size of the information carriers, it is possible for the information carriers which belong to one sorting feature, e.g. a certain language, also to be graduated again in length, or else to bear an index on another side, with the result that there is a further, precise graduation within a stack of information carriers which are assigned to a certain sorting feature. This graduation procedure can continue, in principle, until the resulting graduations are no longer sufficient for accommodating index information in a recognizable form.

However, rather than it being absolutely necessary for indexing to take place in plain text, it is also possible to utilize other possible indexing methods, e.g. the provision of a color code or the use of information carriers of different colors.

It is also possible to apply other known search aids to the information-carrier stack, e.g. colored edge markings together with an index provided on the cover sheet or the base element, or groove-like border cutouts in the stack which, starting from the top, terminate at an information carrier belonging to a certain keyword and display the relevant keyword there.

FIG. 12 shows, furthermore, a combination of adhesive layers 8 and staples 17 by means of which the information carriers are fixed on the base element in the fastening region 15. Of course, it is possible for all known fastening means, also those 8 and 17 which are shown in FIG. 12, to be used individually or, if this is advantageous, in any desired combination with one another.

Figure 13:
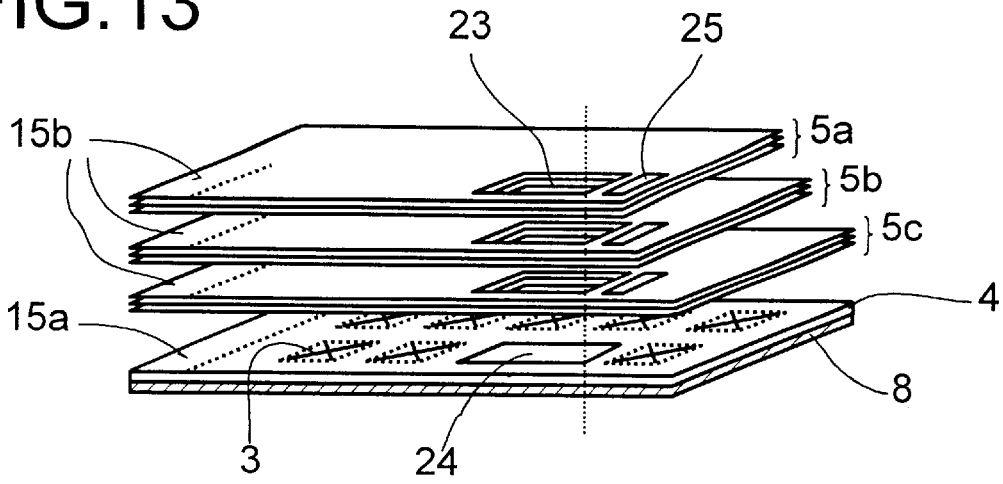

FIG. 13 illustrates schematically, by way of example, in an exploded illustration, a side view of a further particularly expedient embodiment of the label according to the invention. This has, on a sub-surface 24 of the base element 4 which is free of cross-slit through-passages 3, certain important variable data, e.g. patient numbers, batch designations, use-by-date and the like.

Above the base element, FIG. 13 shows three information-carrier stacks 5*a*, 5*b*, 5*c* which, on account of different lengths, produce a stack with an index strip when they are lowered onto the base element in the arrow direction. Each of the three stacks contains information in a language assigned to it. All the information carriers have a window-like opening 23 which, in the stack, produces a viewing window which passes through the base element and through which the data zone 24 of the base element can be seen. At least the uppermost sheet of each of the three stacks has, in the vicinity of the window opening 23, a reserved zone 25 on which the meaning of the data specified on the zone 24 is specified in the language assigned to said stack. For forming the label according to the invention, the parts 5*a*, 5*b* and 5*c* are lowered onto the base element 4 and the constituent parts of the assembly are fixed to one another in the region of the fastening surfaces 15*a* and 15*b*.

This embodiment has the advantage that fixed, standard details may be provided in the zones 25 of all the information carriers, and the variable details (patient or batch numbers and the like) only have to be recorded once on the zone 24 of the base element. This design not only facilitates the production of the labels, but also avoids sources of error and mistakes. It thus also makes a further considerable contribution to the safety of drugs, e.g. in clinical studies.

In an example illustrated in FIG. 13, the zone 24 is located in a surface region of the base element 4 in which there are no through-passages. This illustration is particularly suitable for illustrating the principle of this design. Such an embodiment is realized when, beneath the base-element surface area which is not provided with any through-passages, there are no blisters, or no filled blisters, provided in the blister pack which is to be labeled. If the entire base element is provided with through-passages, then the information zone 24 is provided, if desired, on a surface area located between or alongside the through-passages, e.g. in the region of the information zone 20 shown in FIG. 12. The window through-passages in the information-carrier stack are positioned correspondingly.

In a further preferred embodiment, at least one of the information carriers is configured such that it can be removed wholly or partially, if necessary also in a number of sub-sections, from the information-carrier stack. The uppermost information carrier of the stack is preferably selected for this configuration. In this case, said information carrier is configured such that it can be removed wholly or partially from the stack only by specific, planned handling, rather than by accident. Configurations which are suitable for this purpose are known per se. For example, the information carrier may be perforated or scored (notched) along certain lines, which may also run in undulating form, or it may be prepared for the removal of the sub-sections in some other way, e.g. by specific reduction in the tear resistance of the material, along the lines provided for severing purposes. If the entire information carrier is to be removed from the stack, it is possible for perforation or scoring lines to be positioned around a staple seated in the fastening surface. This makes it possible for the information carrier to be removed from the stack together with that part of the fastening surface which is not gripped by the staple, while that part of the fastening surface which is retained by the staple remains on the stack. Similarly, in a stack which has its constituent parts adhesively bonded one upon the other, the information carrier can be divided up into fastening surface and information surface by perforated or pre-scored separating lines. Of course, it is also possible for the measures which allow an information carrier to be severed specifically from the stack in whole or in part also to be used in combination with one another.

In a further configuration of this embodiment, the severable information carriers or the parts thereof are of such a nature that they can be fixed to other surfaces. It is thus possible for said information carriers to have, for example on the side located opposite the information, a self-adhesive layer protected by a peel-off sheet material, or to be provided with an application of gum which can be activated by water.

In yet a further configuration of the label according to the invention, one or more information carriers of the stack, preferably the uppermost information carrier, is/are configured such that it is possible to sever from the composite arrangement one or more sub-surfaces of said information carrier which may be located at any desired locations of the information carrier and may be of any desired shapes. The severable sub-surfaces are bounded by boundary lines or curves along which the material of the information carrier is weakened by known measures such that the sub-surfaces can be severed from one another, and/or from the rest of the information carrier which remains in the composite label arrangement, along said boundary lines, or they are bounded by the edges of the information carrier. The known measures which serve for weakening the material along the boundary lines are selected appropriately in accordance with the boundary and the shape of the section which is to be severed. Examples of suitable known measures are scoring (notching) or perforation, it also being possible for the perforation holes to be slots (slits) between which only punctiform connections remain between the severable part of the information carrier and that part of the latter which remains in the composite label arrangement. If permitted by the shape and position of the surface-area elements which are to be severed, it is also possible to provoke material fatigue, for example by inflection along a boundary line, said fatigue making it possible for the section to be severed along said line. Furthermore, it is also possible for the carrier material to be slit continuously through the entire material thickness over part of the length of the boundary line and for only the non-slit part of the boundary, by means of which the severable section is still connected to that part of the information carrier which remains in the composite arrangement, to be prepared in the manner described for being torn off.

It is particularly advantageous to have a sheet-like information carrier from which it is possible to sever one or more information-carrier sub-surfaces which may be located at any desired location of the information carrier and may be of any desired shape and, following severing, may be adhesively bonded to other surfaces, the information carrier comprising a sheet-like material having at least three layers, the bottom layer being a coupling-agent-repellant layer. Coupling-agent-repellant, or also adhesive-repellant, here describes a material to which an adhesive layer does indeed adhere, but the coupling connection can be separated again without any notable damage to the layers, in which case a separating force within a predetermined range is to be applied. So-called smooth layers, e.g. a silicone-paper layer, are coupling-agent-repellant. The coupling-agent-repellant layer is adjacent to a coupling-agent layer, and located above the latter is at least one information-carrying layer which is compatible with the coupling agent. In an information carrier of this nature, it is then possible for a section which is to be severed to be prepared by appropriate double notching along at least one boundary line such that, when said section is severed from the information carrier along said boundary line, a free adhesive strip remains on the severed section.

Figure 14A:
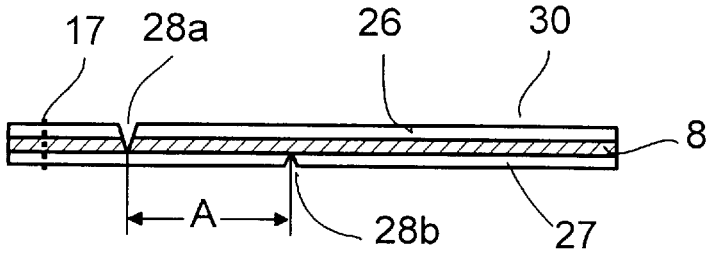

For executing such double notching, the information carrier is notched from both sides by spaced-apart notches such that one notch 28*a* is routed directly from the top side along the boundary line provided, through the information-carrying layer(s) and the adhesive layer to the adhesive-repellant layer, and the second notch 28*b* passes from the underside, preferably essentially parallel to the first, through only the adhesive-repellant layer, and such that the two notches are spaced apart from one another by a predetermined distance A. In this case, the notch which is routed from above is located on the boundary line, but that which is routed from beneath, in contrast, is displaced by the distance A toward the center of the surface-area element which is to be severed. FIG. 14*a* illustrates by way of example, not to scale, a cross section through a section of a three-layer information carrier 30 which is provided with such double notching. Said figure shows the information-carrying layer 26, which is connected to the adhesive-repellant layer 27 via the adhesive layer 8, as well as the two spaced-apart notches 28*a* and 28*b* and the staple 17 by means of which the information carrier is fastened on the labeled pack.

Figure 14B:
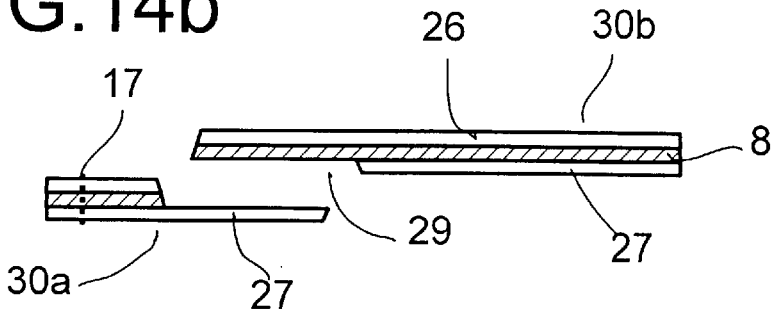

If an information-carrier section prepared in this way is subjected to loading, then, as shown in FIG. 14*b*, it is separated, at the notches, into the two parts 30*a* and 30*b* such that the severed section 30*b* is provided, at the separating edge provided with the double notching, with a free adhesive strip 29 which is of the width A and by means of which said severed section may be adhesively bonded to another surface if desired.

It is possible for such a measure, for example, to increase the safety of clinical studies, to facilitate the documentation for the doctor giving treatment, or to provide the patient with reliable information on the medicament.

Of course, it is also possible for the staples illustrated in FIGS. 14*a* and 14*b* to be replaced by other fastening means. It is also possible for such an information carrier provided with the double notching described to be fastened in any manner known per se, independently of the multipart label according to the invention described above, on containers which are to be labeled. It thus also constitutes in itself an inventive element of the present invention.

It is also possible for one or more information carriers of the stack, preferably the uppermost information carrier, to be provided with one or more information-carrying labels which can be peeled off from the information carrier in whole or in part. This can be made possible, for example, by a manner known per se in that at least that part of the label which is provided for removal purposes—which may be divided off from the rest of the label, if appropriate, by perforated or pre-scored separating lines—rests on a surface area of the information carrier which is provided with adhesive coating. The label is then also adhesively bonded to said locations such that, rather than being severed accidentally, it can only be peeled off from the information carrier specifically and with the application of a force which is not too low. The peeling-off operation may be facilitated if an adhesive-free grip strip or tab is provided on one side or corner of the label, or label part, which is to be removed. It is also possible, for example, for the labels only to be adhesively bonded to the information carrier over part of the surface area and for one or, if necessary, more tearing lines to be provided between the part which is adhesively bonded and that which is not, said tearing lines making it possible for the label part which is not adhesively bonded to be torn off. Of course, it is also possible to use other known measures which are suitable for the desired purpose. Combinations of these measures may also be used for the appropriate configuration of the label according to the invention. It is also possible for the information provided on the tear-off label also to be provided on the surface area which is concealed by the tear-off label before the tearing-off operation.

In a further preferred embodiment, the label according to the invention has a closure means which prevents the information carriers fastened with swing action from swinging open, i.e. which can keep the label in the closed state. Such a closure means can be realized in various ways.

In the simplest case, the uppermost information carrier has a continuation which projects beyond the label, is completely or partially coated on its underside with an adhesive and, if appropriate, has a grip tab which is not coated with adhesive. In the closed state of the label, said continuation can be pressed onto the surface of the pack and then produces a re-releasable connection between the uppermost information carrier and the pack, said connection preventing accidental opening of the label. The affinity of the adhesive is expediently coordinated with the material of the pack such that the necessary adhesion force is provided, but the surface of the pack is not damaged when the adhesive-bonding connection is separated. This achieves the situation where the adhesive-bonding surface can be opened and closed a number of times. The force which is necessary for releasing the closure can be set by way of the size of the adhesive-bonding surface. For example, the width of the continuation may be smaller than the width of the uppermost information carrier, or the continuation may have a punched-hole arrangement which reduces the size of the adhesive-bonding surface.

A further possible way of realizing a closure means may comprise, for example, a reversible extendable thread or band (e.g. rubber band) which is fastened at two points, spaced apart from the fastening region, on two different edges of the base element and can be drawn over the information-carrier stack.

In another embodiment, there extends either from the base element or from one of the lowermost information carriers, preferably the lowermost information carrier, of the stack, at least one edge location spaced apart from the fastening region, preferably at the edge located opposite the fastening region, a flexible continuation which can be made to overlap, by bending, with the uppermost information carrier or with an appropriately positioned continuation of the same. In the overlapping region, the overlapping parts are formed such that they interact to form a closure means.

It is also possible for such a closure means to be of purely mechanical configuration. For example, one of the elements of the closure means may be designed as a tab or knob or in some other way as a male part of a plug-in connection which can be introduced into an opening, e.g. a slit or a part which belongs to the other element of the closure means and is designed in some other way as a female part of a plug-in connection, in which case, during the introduction, the elements of the plug-in connection are subjected to more or less pronounced elastic reversible deformation which, once the elements have been united to the full extent, reverses and thus produces a fixed but releasable connection.

It is also possible for the elements of the closure means to bear, at least in the overlapping region, coupling surfaces which interact to give a fixed but releasable connection and are positioned such that they come to rest one upon the other when the flexible continuation extending from the base element or one of the bottom information carriers is brought into contact with the uppermost information carrier or the continuation of the same.

Examples of suitable coupling-surface pairings are a contact-adhesive surface combined with an adhesive-repellant smooth-layer surface or the elements of a touch-and-close fastener, that is to say one surface provided with small hooks and another surface provided with loops.

If a closure is provided by a contact-adhesive surface interacting with an adhesive-repellant surface, it is expedient to provide a continuation on the base element or on one of the bottom information carriers, preferably the lowermost information carrier, and, if appropriate, also on one of the uppermost information carriers, preferably the uppermost information carrier. The continuation extending from the base element or one of the bottom information carriers is of such a length that, bent upwards, it overlaps with one of the top information carriers, preferably the uppermost information carrier, or with a downwardly bent continuation of the same. In the overlapping region, one of the overlapping elements is provided with an adhesive layer on the surface which comes into contact with the other elements, and the other element is provided, at the corresponding location, with an adhesive repellant smooth surface. For the reversible closure, the closure elements are bent together, brought into contact on the functional surfaces and pressed together.

This embodiment allows two possible methods of label closure: if the continuation extends from the base element, then, during closure, the entire information-carrier stack is fixed to the pack. If, in contrast, the continuation extends from the bottom information carrier, preferably the lowermost information carrier, then, once the closure has been closed, it is possible for the information-carrier stack to be swung up in assembled form, with the result that the base element is accessible. This has the advantage, for example, that it is possible for goods, e.g. tablets, capsules or the like, to be removed from the blister pack without the label having to be opened.

In a specific embodiment which allows straightforward production, a closure continuation which extends from the base element may be realized as follows:

A sheet-like structure laminated on one side with silicone paper or an analogous, adhesive-repellant material is used to produce a blank of the magnitude of the adhesive-bonding region of the base element which has the necessary closure continuation. The inner region of said blank is then punched out so as to expose the base-element surface area provided with through-passages, this producing a frame 31 on which the closure continuation 32 is seated. Said frame is positioned on the base element by way of the adhesive-compatible surface and is fixed in this way. The adhesively bonded frame leaves the majority of the coupling surface of the base element exposed, with the result that the latter can still be fixed reliably to the pack.

Figure 15A:
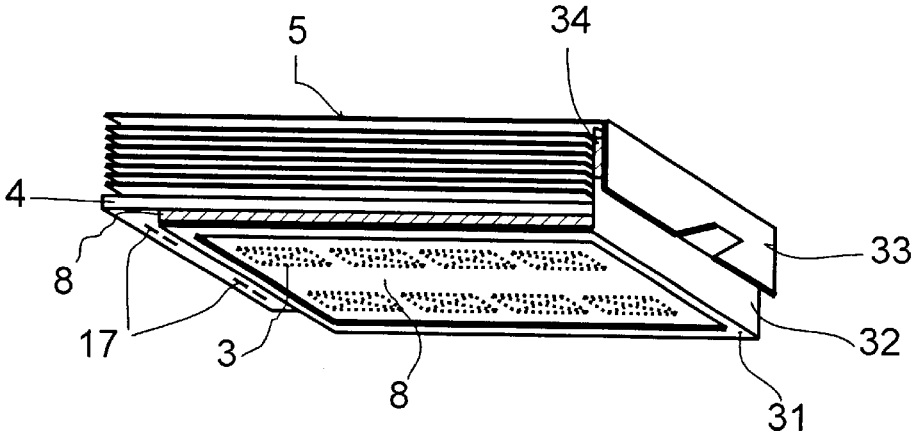

FIG. 15*a* illustrates a view obliquely from beneath, schematically and not to scale, of such an embodiment of the multipart label according to the invention.

It shows the frame 31, which is fixed to the base element 4 by the adhesive layer 8, and the adjoining continuation 32, which has the silicone-paper layer on the surface which can be seen in the drawing, as well as the continuation 33, which is positioned on the continuation 32 by way of its adhesive layer 34, the latter coming to rest on the silicone side of the continuation 32. The cross-slit through-passages 3, which are located beneath the adhesive layer 8, are illustrated by dots in the figure.

Figure 15B:
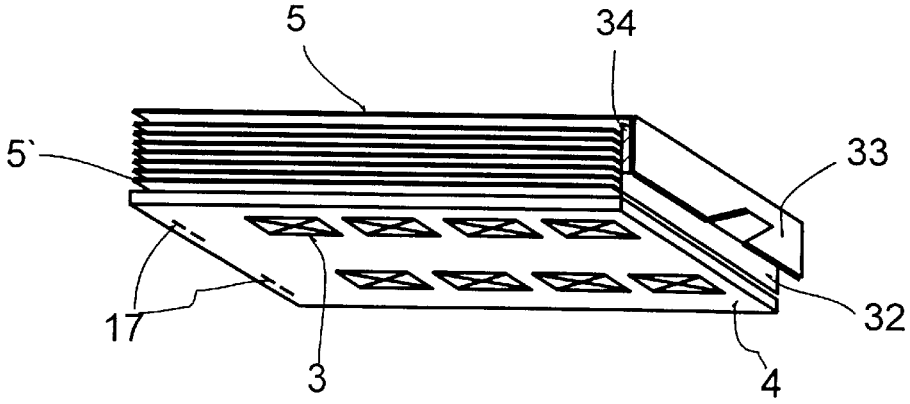

FIG. 15*b* illustrates a view obliquely from beneath, schematically and not to scale, of a closable embodiment of the label according to the invention in which the closure continuation 32 extends from the lowermost information carrier 5 rather than from the base element.

Multipart labels according to the invention which have a number of the preferred features mentioned above are particularly preferred.

The present invention also relates to a process for producing the multipart label according to the invention. In a preferred production process, the base element and the information carriers are cut out of a continuous strip of a suitable sheet-like material of sufficient strength. In this case, the width of the strip corresponds to the width of the pack, and the length is expediently a whole-numbered multiple of the pack length and, if desired, an added length of the magnitude of the pack thickness.

FIG. 10*a* illustrates such a strip and the handling of the strip, which is described hereinbelow. A section of said strip, usually the first section, is provided, e.g. by punching, with the through-passages necessary for the base element. At the end of the base element, the strip is made flexible by suitable measures along a line in the direction transverse to the longitudinal direction illustrated by the dashed line 18*a* in FIGS. 10*a* and 10*b*—with the result that it can be swung against the base element along said line. A flexible transverse line (dashed lines 18*b*) is subsequently produced in each case at a distance equal to the pack length, this producing a multiplicity of information-carrier surfaces. If a distance 19 equal to the pack thickness is desired between the base element and the information-carrier stack, as is illustrated in FIG. 10*b*, the strip is first of all made flexible, at said distance from the line 18*a*, at 18*c* in the direction transverse to its length, and the flexible transverse lines 18*b* are then produced, as has been described above.

Once the base element has been fastened on the pack, the information-carrier surfaces may be folded together in zig-zag form to give an information-carrier stack, this producing the embodiment of FIG. 9, or it is possible for in each case two successive information-carrier sections to be adhesively bonded by way of the surfaces which are directed toward one another, this producing the embodiment of FIG. 8.

In an alternative production process, a base element and information carriers are cut to size from one of the above-mentioned materials, it being possible for the material for the base element and information carriers to be the same or different. Through-passage slit formations or open holes are punched from the blank for the base element, it being possible for said through-passages or holes to be assigned by their shape or position in each case to one or more blisters of the blister pack which is to be labeled, and the size of said through-passages or holes allowing the packed objects to pass through. Provided on the blanks for the information carriers are relatively large surfaces for accommodating the information (information surfaces) and, if necessary, relatively small surfaces for fastening the individual elements on one another (fastening surfaces), and said surfaces, if appropriate, are prepared for said functions for example by the application of adhesives to the fastening surfaces and/or the production of surface areas, in the information surfaces, which are suitable for accommodating information and on which it is possible to print and/or provide adhesive bonding. Flexible locations of inflection functioning in a hinge-like manner are introduced between information and fastening surfaces of the information carriers, and then the information carriers and base elements are fastened on one another on the fastening surfaces by the abovementioned known mechanical or adhesive fastening means.

A variant of this production process consists in the covering sheet material or the thermoformed sheet material of the blister pack, said thermoform sheet material having the blister-like deformations, being used as the base element and prepared for this function.

For producing preferred embodiments, the production processes described may be modified and/or supplemented as can be seen clearly from the description of these embodiments and, if appropriate, the figures.

Free adhesive layers are expediently covered and protected with peel-off sheet materials. The information may be provided on the information surfaces in a production stage most appropriate for the operational conditions. If desired, it is also possible for the labels to be supplied without information to consumers who wish to provide the information themselves. The sequence of these production steps may also be adapted as far as possible to operational requirements.

The present invention also relates to the use of the multipart label according to the invention for labeling primary and secondary packs, in particular blister packs.

The following exemplary embodiments illustrate the production of multipart labels according to the invention. However, the present invention is not restricted to the embodiments illustrated.

EXAMPLE 1

For a blister pack with a covering surface of 6.5×5.5 cm and 10 blister-like depressions with a top opening of 0.75×1.75 cm and a depth of 1.0 cm, these being arranged uniformly in two rows, with the result that a central web of 1 cm in width remains between the two rows of blisters and frame webs of 0.5 cm in width remain between the blisters of one row and the borders of the covering surface, an appropriate multipart label according to the invention is produced as follows: A rectangular strip of 72.6×5.5 cm is cut out of a heat-bonded polyester nonwoven fabric with a weight per unit area of 100 g/m$^2$. On its top side, the strip is provided with a titanium-dioxide-containing paper coating. Following drying, a contact-adhesive coating is applied to the underside and, following evaporation, said underside is covered with an appropriate PTFE-impregnated peel-off protective sheet material.

The surface area of 6.5×5.5 cm located at the start of the strip prepared in this way has 10 holes punched out of it in accordance with the size and arrangement of the blister openings of the blister pack.

The protective sheet material covering the contact adhesive is then slit at distances of 6.5 cm, 7.6 cm and subsequently after every further 6.5 cm. Beginning from the end of the strip, the protective sheet materials are then peeled off from in each case two of the sections of 6.5 cm in length, and the sections are folded together such that the adhesive-bonding zones come to rest precisely one above the other, and they are then united with one another by a brief application of pressure. This process is continued until 10 of the surface areas have been united to give 5 double surfaces. A strip zone of 1.1 cm in length and the starting zone of the strip provided with punched arrangements then remain.

The punched zone serves as the base element for fastening the label on the covering surface of the blister pack, and the zone of 1.1 cm in length serves for depositing the information carriers on the blister side of the pack.

Either information can be provided on the free sides of the information carriers in accordance with the above described production of the label, e.g. by text-carrying self-adhesive labels,being adhesively bonded thereto, or the information can be printed on at any desired point in time once the paper coating has dried.

The information-carrying surface may also be prepared in whole or in part for accommodating data stored in some other way, e.g. magnetic or optoelectronic data. The application of the paper coating is then replaced wholly or in part by the provision of another corresponding storage medium.

It is also possible to produce smaller multipart labels according to the invention in an analogous manner, e.g. labels in which the central web between the blisters is only of approximately 0.5 cm in width and the frame webs are only of approximately 0.3 cm in width.

EXAMPLE 2

Example 1 is repeated, the only difference being that the nonwoven-fabric strip is only provided with an adhesive layer, and covered with protective sheet material, in its starting section of 6.5 cm in length. Over the rest of the length, it is coated with the paper coating on both sides. Following punching of the through-passages, the strip is folded to give a zigzag stack.

EXAMPLE 3

For the same blister pack as an Example 1, an appropriate multipart label according to the invention is produced as follows:

a) Production of a Base Element

A rectangular section of 7.5×5.5 cm is cut out of a heat-bonded polyester-fiber nonwoven fabric with a weight per unit area of 120 g/m$^2$. On its top side, the strip is provided with a titanium-dioxide-containing paper coating. Following drying, a contact-adhesive coating is applied to the underside and, following evaporation, said underside is covered with an appropriate PTFE-impregnated peel-off protective sheet material.

A surface area of 6.5×5.5 cm which is measured from the border of the section has 10 holes punched out of it in accordance with the size and arrangement of the blister openings of the blister pack. A hole-free overhang of 1 cm in width remains. A label number which recurs on the pack which is to be labeled is then printed onto the web of 1 cm in width provided between the rows of holes.

b) Production of the Information Carriers rectangular sections of 7.5×5.5 cm are cut out of a heat-bonded polyester-fiber nonwoven fabric with a weight per unit area of 80 g/m$^2$. On the top side and underside, a surface region of 6.5 cm, calculated from the right-hand border, is provided with a titanium-dioxide-containing paper coating. The strip of 1 cm in width which remains free constitutes the fastening surface of the information carriers. Thereafter, each of the information carriers has the index strip cut into it in accordance with the envisaged position thereof in the stack.

The information carriers prepared in this way are provided one after the other with the information intended for them. The index strips are provided with the keyword codes, e.g. the country codes. The uppermost information carrier receives, on the top side, the same essential basic information which has also been printed on the information region of the base element, and a label number which occurs on the pack which is to be labeled is also printed on here in a reserved surface region along the short edge.

Thereafter, the information carriers are stacked in the envisaged sequence flush over the base element and the stack as a whole, made of the 10 information carriers and base element, is stapled, using a stapling machine, by means of a wire staple.

Instead of the paper coating, it is also possible for an unfilled melamine resin to be coated onto the information region of the base element and onto the information surfaces of the information carriers. Once the resin has set, the smooth, stiffened surfaces obtained in this way can have labels, preferably self-adhesive labels, which bear the necessary information, adhesively bonded to them.

EXAMPLE 4

A base element is produced as described in Example 2, the only difference being that, following drying, a contact adhesive is applied to the strips in a surface region of 1 cm, calculated from the left-hand border, on both sides and, following evaporation, said surface region is covered with a peel-off protective sheet material. Once the information carriers have been provided with printing, they are, as in Example 2, stacked flush on the base element and clamped firmly in position. The protective sheet materials are then removed one after the other from the fastening region of the base element and from the fastening surfaces of the information carriers and adhesively bonded to the abutting adhesive-bonding surfaces by a brief, pronounced application of pressure.

EXAMPLE 5 a) Production of a Base Element

A rectangular section of 7.5×5.5 cm is cut out of a heat-bonded polyester-fiber nonwoven fabric with a weight per unit area of 120 g/m$^2$. On its top side, the strip is provided with a titanium-dioxide-containing paper coating. Following drying, a contact-adhesive coating is applied to the underside and, following evaporation, said underside is covered with an appropriate PTFE-impregnated peel-off protective sheet material.

A surface area of 6.5×5.5 cm which is measured from the border of the section has 10 holes punched out of it in accordance with the size and arrangement of the blister openings of the blister pack. A hole-free overhang of 1 cm in width remains.

A label number which occurs on the pack which is to be labeled is then printed onto the web of 1 cm in width provided between the rows of holes.

b) Production of the Information Carriers

Six rectangular sections of 13×5.5 cm are cut out of a heat-bonded polyester-fiber nonwoven fabric with a weight per unit area of 80 g/m$^2$. On the top side and underside, surface regions of 6.3 cm, calculated from the right-hand border and from the left-hand border, are provided with a titanium-dioxide-containing paper coating. This produces information-carrier strips which, apart from a zone of 0.4 cm in width located in the middle, are provided with the paper coating on both sides. Following drying, the strips are folded in the middle, where no paper coating has been applied. Thereafter, each of the information carriers has the index strip cut into it in accordance with the envisaged position thereof in the stack.

The information carriers prepared in this way are provided one after the other with the information intended for them. The index strips are provided with the keyword codes, e.g. the country codes. The uppermost information carrier receives, on the top side, essential basic information, and a label number which occurs on the pack which is to be labeled is also printed on here in a reserved surface region along the x short edge.

The information-carrier strips 1 to 3 are positioned one above the other, folded together in the paper-coating-free middle and, in the folded state, sewn onto the overhang region of the base element produced at a). The procedure is exactly the same for strips 4 to 6. Thereafter, the strip bundle, connected to the overhang of the base element, is swung to the right, and the information-carrier stack is formed as a result.

LIST OF DESIGNATIONS

1 Multipart label according to the invention
2 Blister pack
3 Through-passages
4 Base element
5 Information carrier
6 Covering sheet material of the blister pack
7 Thermoformed sheet material
**7*a*** Thermoformed side of the thermoformed sheet material; "blister side" of the blister pack
8 Adhesive layer
9 Through-passage slit formation in the closed state
10 Through-passage slit formation in the open state
11 Small surface-area elements of the base element
12 Overhang
13 Helix
14 Information surface
**15*a*** Fastening surface of the base element
**15*b*** Fastening surface of the information carrier
16 Flexible connection
17 Fastening means, e.g. staples or rivets
**18*a*** Folding lines
**18*b*** Folding lines
**18*c*** Folding lines
19 Distance corresponding to the pack thickness
20 Zone for identification symbol (label number)
21 Label
22 Index
23 Window hole
24 Zone for variable data
25 Zone for data definition
26 Information-carrying layer
27 Adhesive-repellant layer
**28*a*** Notch from above
**28*b*** Notch from beneath
29 Free adhesive surface
30 Information carrier with severable surface-area element
**30*a* That part of the information carrier (30)** which remains on the labeled article
**30*b* Severed surface-area element of the information carrier (30)**
31 Frame for closure continuation 32
32 Bottom closure continuation
33 Top closure continuation
34 Adhesive-bonding layer

I claim:

1. A multipart label for providing information, in particular content-related details, on blister packs, which packs comprise a regular arrangement of a multiplicity of blister-like depressions which have been produced in an otherwise planar plastic sheet material and also comprise a covering sheet material fixed on the remaining planar surface area of the planar plastic sheet material, the blister-like depressions serving for accommodating the packed objects and the covering protecting the objects against dropping out, said multipart label having a text-carrying surface which is larger than the pack surfaces, comprising:

A) a sheet-like base element which is provided with through-passages having free openings and is suitable for fixing the label reliably on the pack which is to be labeled, or which is itself part of the pack, the through-passages of which are each assigned to one or more of the pack blisters provided for accommodating the pack contents, the minimum size of the through-passage opening being selected such that an individual object of the pack contents can pass through, and the maximum size of the free opening of the through-passages being selected such that at least a framework remains therebetween to ensure that the base element is fixed reliably on the covering sheet material or on the blister side of the plastic sheet material, said base element being permanently fixed to the blister pack by fastening means, and B) one or more sheet-like information carriers which are fastened with swing action on the base element.

2. A multipart label as claimed in claim 1, wherein the through-passages are designed as open holes which are assigned to one or more blisters of the blister pack.

3. A multipart label as claimed in claim 1, wherein the through-passages are designed as through-passage slit formations which are assigned to one or more blisters of the blister pack.

4. A multipart label as claimed in claim 1, wherein the base element, by way of which the label according to the invention is attached to the blister pack, is fixed on the covering sheet material or on the blister side of the blister pack.

5. A multipart label as claimed in claim 1, wherein the base element projects beyond the pack surface on which it is to be fixed, an overhang surface being formed in the process.

6. A multipart label as claimed in claim 1, wherein a multiplicity of information carriers are connected to the base element.

7. A multipart label as claimed in claim 1, wherein the first, lowermost information carrier is fastened directly on the base element or an overhang of the base element, and each further information carrier located thereabove is then fastened on the preceding information carrier, the higher information carrier either being fastened in each case on that edge of the information carrier located therebeneath by means of which the latter is fastened on its predecessor or on the base element, or the higher information carrier being fastened in each case on the free edge of the predecessor.

8. A multipart label as claimed in claim 1, wherein the base element is part of the blister pack.

9. A multipart label as claimed in claim 1, wherein it has a closure means.

10. A method for labeling primary and secondary packs, comprising attaching thereto a multipart label as claimed in claim 1.

11. The method as claimed in claim 10 for labeling blister packs.

12. A sheet-like formation carrier for labeling packs from which it is possible to sever one or more information-carrying sections which may be located at any desired locations of the information carrier and may be of any desired shape, wherein the information carrier is configured in at least three layers, the bottom layer being a coupling-agent-repellant layer, adjacent to this a coupling-agent layer and, above the latter, at least one information-carrying layer which is compatible with the coupling agent, wherein the section which is to be severed from the information carrier is prepared by appropriate double notching along at least one boundary line, and wherein the double notching is executed such that one notch is routed directly from the top side, on the boundary line provided, through the information-carrying layer and the adhesive layer to the adhesive-repellant layer and the second notch passes from the underside through only the adhesive-repellant layer, and that the two notches are spaced apart from one another by a predetermined distance A, the notch which is routed from above being located on the boundary line provided, but that which is routed from beneath, in contrast, being displaced by the distance A toward the center of the surface-area element which is to be severed whereby, when said section is severed from the information carrier along said boundary line, a free strip of adhesive remains on the severed section.

13. An information carrier as claimed in claim 12, wherein the double notching is executed such that one notch is routed directly from the top side, on the boundary line provided, through the information-carrying layer(s) and the adhesive layer to the adhesive-repellant layer, and the second notch passes from the underside, preferably essentially parallel to the first notch, through only the adhesive-repellant layer, and that the two notches are spaced apart from one another by a predetermined distance A, the notch which is routed from above being located on the boundary line provided, but that which is routed from beneath, in contrast, being displaced by the distance A toward the center of the surface-area element which is to be severed.

14. A sheet-like information carrier for labeling packs from which it is possible to sever one or more information-carrying sections which may be located at any desired locations of the information carrier and may be of any desired shape, wherein the information carrier is configured in at least three layers, the bottom layer being a coupling-agent-repellant layer, adjacent to this a coupling-agent layer and, above the latter, at least one information-carrying layer which is compatible with the coupling agent, wherein the section which is to be severed from the information carrier is prepared by appropriate double notching along at least one boundary line, and wherein the double notching is executed such that one notch is routed directly from the top side, on the boundary line provided, through the information-carrying layer and the adhesive layer to the adhesive-repellant layer and the second notch passes from the underside through only the adhesive-repellant layer, and that the two notches are spaced apart from one another by a predetermined distance A, the notch which is routed from above being located on the boundary line provided, but that which is routed from beneath, in contrast, being displaced by the distance A toward the center of the surface-area element which is to be severed whereby, when said section is severed from the information carrier along said boundary line, a free strip of adhesive remains on the severed section, wherein it is a multipart label comprising a sheet-like base element and one or more sheet-like information carriers which are fastened with swing action on the base element.

15. A process for producing a multipart label, wherein a sheet-like base element provided with through-passages having free openings and suitable for fixing the label reliably on a blister pack, or itself being part of the pack, the through-passages of which being assigned to one or more of the pack blisters provided for accommodating the pack contents, the minimum size of the through-passage opening being selected such that an individual object of the pack contents can pass through, and the maximum size of the free opening of the through-passages being selected such that at least a framework remains therebetween to ensure that the base element is fixed reliably on the covering sheet material or on the blister side of the plastic sheet material, said base element being permanently fixed to the blister pack by fastening means, and one or more sheet-like information carriers which are fastened with swing action on the base element, are cut as a continuous strip out of a suitable sheet-like material, the width of the strip in this case corresponding to the width of the pack, and the length being a whole-numbered multiple of the pack length and, if desired, an added length of the magnitude of the pack thickness, the first section is provided with the through-passages necessary for the base element, the strip at the end of the base element is made flexible along a line in the direction transverse to the longitudinal direction, with the result that it can be swung against the base element along said line, if appropriate, first of all at a distance from the end of the base element which is equal to the pack thickness, the strip is then made flexible by suitable measures along a line in the direction transverse to its length, and a flexible transverse line is subsequently produced in each case at a distance equal to the pack length, this producing a multiplicity of information-carrier surfaces which are either folded together in zigzag form to give an information-carrier stack, or of which in each case two successive ones are adhesively bonded by way of the surfaces which are directed toward one another.

16. process for producing a multipart label, wherein a sheet-like base element provided with through-passages having free openings and suitable for fixing the label reliably on a blister pack, or itself being part of the pack, the through-passages of which being assigned to one or more of the pack blisters provided for accommodating the pack contents, the minimum size of the through-passage opening being selected such that an individual object of the pack contents can pass through, and the maximum size of the free opening of the through-passages being selected such that at least a framework remains therebetween to ensure that the base element is fixed reliably on the covering sheet material or on the blister side of the plastic sheet material, said base element being permanently fixed to the blister pack by fastening means, and one or more sheet-like information carriers which are fastened with swing action on the base element, are cut to size from a suitable material, it being possible for the materials for the base element and information carriers to be the same or different, through-passages are punched from the blank for the base element, the arrangement of said through-passages corresponding to the arrangement of the blisters in the blister pack which is to be labeled, and the size of said through-passages allowing the packed objects to pass through, provided on the blanks for the information carriers are relatively large surfaces for accommodating the information (information surfaces) and, if necessary, relatively small surfaces for fastening the individual elements on one another (fastening surfaces), these surfaces, if appropriate, are prepared for their functions, flexible locations of inflection functioning in a hinge-like manner are introduced between information and fastening surfaces of the information carriers, and then the information carriers and base elements on the fastening surfaces are fastened on one another on the fastening surfaces by known mechanical or adhesive fastening means.

* * * * *

UNITED STATES PATENT AND TRADEMARK OFFICE

CERTIFICATE OF CORRECTION

PATENT NO. : 6,669,236 B1
DATED : December 30, 2003
INVENTOR(S) : Hoellwarth-Oberholz, Marc-Oliver It is certified that error appears in the above-identified patent and that said Letters Patent is hereby corrected as shown below:

Column 30,
Line 3, before "process" insert -- A --.

Signed and Sealed this

Twenty-second Day of June, 2004

JON W. DUDAS
*Acting Director of the United States Patent and Trademark Office*